US011993438B2

(12) United States Patent
Wetsch

(10) Patent No.: US 11,993,438 B2
(45) Date of Patent: May 28, 2024

(54) USER-EXPANDABLE PACKAGING

(71) Applicant: Pregis Innovative Packaging LLC, Deerfield, IL (US)

(72) Inventor: Thomas D. Wetsch, Naples, FL (US)

(73) Assignee: Pregis Innovative Packaging LLC, Chicago, IL (US)

( * ) Notice: Subject to any disclaimer, the term of this patent is extended or adjusted under 35 U.S.C. 154(b) by 0 days.

(21) Appl. No.: 17/365,854

(22) Filed: Jul. 1, 2021

(65) Prior Publication Data

US 2022/0002069 A1 Jan. 6, 2022

Related U.S. Application Data

(60) Provisional application No. 63/107,312, filed on Oct. 29, 2020, provisional application No. 63/107,333,
(Continued)

(51) Int. Cl.
*B65D 81/02* (2006.01)
*B65B 51/10* (2006.01)
(Continued)

(52) U.S. Cl.
CPC ..... *B65D 65/42* (2013.01); *B65B 51/10* (2013.01); *B65B 61/06* (2013.01); *B65B 61/24* (2013.01);
(Continued)

(58) Field of Classification Search
CPC ..... B65D 75/30; B65D 75/42; B65D 75/527; B65D 81/03; B65D 81/3266; B65D 2581/02
(Continued)

(56) References Cited

U.S. PATENT DOCUMENTS 1,686,787 A 10/1928 Bates
1,974,339 A 9/1934 Mcdonald
(Continued)

FOREIGN PATENT DOCUMENTS

JP H05170210 A 7/1993
JP H07165266 A 6/1995
(Continued)

OTHER PUBLICATIONS

International Search Report and Written Opinion for International Application No. PCT/US21/40180, filed Jul. 1, 2021, dated Oct. 6, 2021.

*Primary Examiner* — Luan K Bui
(74) *Attorney, Agent, or Firm* — Fox Rothschild LLP

(57) ABSTRACT

A packaging material web stock is provided. The packaging material web stock can include first and second plies overlaid and sealed to each other at a plurality of seals that include a plurality of transverse seals extending transversely across the plies, wherein a plurality of interior cavities are defined between the plies and the transverse seals, the first and second plies arranged in a web that includes a plurality of packaging units arranged longitudinally in a series along the web, wherein the first and second plies form walls of the packaging units, and at least some of the packaging units include at least one of the interior cavities, and an expansion material disposed in the interior cavities in an unexpanded configuration, wherein the expansion material is arranged within the inner cavities such that, when expanded to the expanded configuration, the expansion material is configured to provide cushioning in the walls.

19 Claims, 26 Drawing Sheets

Related U.S. Application Data filed on Oct. 29, 2020, provisional application No. 63/105,420, filed on Oct. 26, 2020, provisional application No. 63/069,571, filed on Aug. 24, 2020, provisional application No. 62/706,110, filed on Jul. 31, 2020, provisional application No. 63/046,828, filed on Jul. 1, 2020.

(51) Int. Cl.

| | |
|---|---|
| ***B65B 61/06*** | (2006.01) |
| ***B65B 61/24*** | (2006.01) |
| ***B65B 67/12*** | (2006.01) |
| ***B65D 27/14*** | (2006.01) |
| ***B65D 65/40*** | (2006.01) |
| ***B65D 65/42*** | (2006.01) |
| ***B65D 75/30*** | (2006.01) |
| ***B65D 75/42*** | (2006.01) |
| ***B65D 75/52*** | (2006.01) |
| ***B65D 81/03*** | (2006.01) |
| ***B65D 81/32*** | (2006.01) |

(52) U.S. Cl.

CPC ..... *B65B 67/1255* (2013.01); *B65D 27/14* (2013.01); *B65D 65/40* (2013.01); *B65D 75/30* (2013.01); *B65D 75/42* (2013.01); *B65D 75/527* (2013.01); *B65D 81/03* (2013.01); *B65D 81/3266* (2013.01); *B65B 2067/1283* (2013.01); *B65D 2581/02* (2013.01)

(58) Field of Classification Search

USPC ..... 206/521–524, 591, 592; 383/110; 428/71, 158

See application file for complete search history.

(56) References Cited

U.S. PATENT DOCUMENTS

| | | | | | |
|---|---|---|---|---|---|
| 2,649,199 | A * | 8/1953 | Werman | B65D 75/52 | 602/41 |
| 2,847,915 | A | 8/1958 | Rapp | | |
| 3,140,816 | A | 7/1964 | Schultz | | |
| 3,359,703 | A | 12/1967 | Quaadgras | | |
| 3,460,740 | A | 8/1969 | Hagen | | |
| 3,469,769 | A | 9/1969 | Guenther | | |
| 3,616,158 | A * | 10/1971 | Rubens | B32B 27/302 | 428/161 |
| 3,642,550 | A | 2/1972 | Doll | | |
| 3,750,907 | A | 8/1973 | Steele | | |
| 3,868,056 | A | 2/1975 | Keren | | |
| 3,948,436 | A | 4/1976 | Bambara | | |
| 4,193,499 | A * | 3/1980 | Lookholder | B65D 81/03 | 53/472 |
| 4,232,788 | A * | 11/1980 | Roth | B65D 81/3272 | 264/45.2 |
| 4,620,633 | A * | 11/1986 | Lookholder | B65D 81/03 | 53/472 |
| 4,726,804 | A * | 2/1988 | Stitcher | B31B 70/88 | 493/917 |
| 4,738,391 | A | 4/1988 | Wiseman | | |
| 4,999,975 | A | 3/1991 | Willden et al. | | |
| 5,129,519 | A * | 7/1992 | David | B65D 81/1075 | 206/592 |
| 5,199,795 | A * | 4/1993 | Russo | B65D 85/84 | 604/408 |
| 5,391,136 | A | 2/1995 | Makowka | | |
| 5,429,576 | A | 7/1995 | Doderer-Winkler | | |
| 5,476,175 | A | 12/1995 | Jaszai | | |
| 5,554,093 | A * | 9/1996 | Porchia | B65D 33/255 | 493/243 |
| 6,410,119 | B1 | 6/2002 | De Luca et al. | | |
| 6,435,348 | B1 * | 8/2002 | Pasquesi | B65D 81/03 | 206/390 |
| 6,652,933 | B2 | 11/2003 | Hall | | |
| 6,713,137 | B1 | 3/2004 | Andersson et al. | | |
| 6,740,373 | B1 | 5/2004 | Swoboda et al. | | |
| 7,807,253 | B2 | 10/2010 | Kannankeril | | |
| 7,926,507 | B2 | 4/2011 | Wetsch et al. | | |
| 8,061,110 | B2 | 11/2011 | Wetsch | | |
| 8,128,770 | B2 | 3/2012 | Wetsch et al. | | |
| 8,746,483 | B2 | 6/2014 | Sierra-Gomez et al. | | |
| 9,028,386 | B2 * | 5/2015 | Fraser | B31B 70/74 | 493/267 |
| 9,573,342 | B2 | 2/2017 | Frei et al. | | |
| 9,615,642 | B2 | 4/2017 | Bergh et al. | | |
| 9,827,711 | B2 * | 11/2017 | Wetsch | B29C 66/21 | |
| 10,183,458 | B2 | 1/2019 | Fu et al. | | |
| 10,870,535 | B2 | 12/2020 | Olness | | |
| 10,926,935 | B2 | 2/2021 | Martin | | |
| 11,084,637 | B1 | 8/2021 | Hoffman | | |
| 2003/0211268 | A1 | 11/2003 | Hillemann et al. | | |
| 2004/0000581 | A1 | 1/2004 | Brandolini et al. | | |
| 2004/0005100 | A1 | 1/2004 | Versluys | | |
| 2005/0152624 | A1 | 7/2005 | Versluys | | |
| 2008/0092488 | A1 | 4/2008 | Gabrielsen et al. | | |
| 2008/0298724 | A1 | 12/2008 | Liao et al. | | |
| 2009/0078595 | A1 | 3/2009 | McKinley et al. | | |
| 2010/0092758 | A1 * | 4/2010 | Slovencik | B65D 81/052 | 425/542 |
| 2010/0282824 | A1 | 11/2010 | Kannankeril et al. | | |
| 2010/0330330 | A1 | 12/2010 | Luca et al. | | |
| 2011/0041462 | A1 | 2/2011 | Lin | | |
| 2011/0153527 | A1 | 6/2011 | Smythe | | |
| 2011/0172072 | A1 | 7/2011 | Wetsch et al. | | |
| 2011/0192121 | A1 | 8/2011 | Kannankeril et al. | | |
| 2013/0303351 | A1 * | 11/2013 | Fu | B29C 44/445 | 493/54 |
| 2014/0087177 | A1 | 3/2014 | Huang et al. | | |
| 2014/0261752 | A1 | 9/2014 | Wetsch | | |
| 2015/0291335 | A1 | 10/2015 | Wetsch | | |
| 2015/0314940 | A1 | 11/2015 | Matta | | |
| 2016/0137383 | A1 | 5/2016 | Wetsch et al. | | |
| 2017/0274588 | A1 | 9/2017 | Mauéet al. | | |
| 2018/0093441 | A1 | 4/2018 | Wetsch | | |
| 2018/0148246 | A1 | 5/2018 | Fu et al. | | |
| 2019/0031415 | A1 | 1/2019 | Kumar | | |
| 2019/0062028 | A1 | 2/2019 | Getty et al. | | |
| 2019/0225406 | A1 | 7/2019 | Kim | | |
| 2019/0291907 | A1 | 9/2019 | Wetsch et al. | | |
| 2020/0024049 | A1 | 1/2020 | Borrero et al. | | |
| 2020/0115082 | A1 | 4/2020 | Hess et al. | | |
| 2020/0270048 | A1 | 8/2020 | Goodrich | | |
| 2022/0032598 | A1 | 2/2022 | Wetsch | | |

FOREIGN PATENT DOCUMENTS

| | | | |
|---|---|---|---|
| WO | 2000069747 | A1 | 11/2000 |
| WO | 2012033998 | A2 | 3/2012 |
| WO | 2014015060 | A2 | 1/2014 |
| WO | 2014175792 | A1 | 10/2014 |
| WO | 2019140065 | A1 | 7/2019 |

* cited by examiner

USER-EXPANDABLE PACKAGING

CROSS-REFERENCE TO RELATED APPLICATION

The present application claims priority to U.S. Provisional Patent Application No. 63/046,828, filed Jul. 1, 2020, entitled "EXPANDABLE WALL BAGS IN SERIES;" U.S. Provisional Patent No. 62/706,110, filed Jul. 31, 2020, entitled "EXPANDABLE WALL BAGS IN SERIES;" U.S. Provisional Patent Application No. 63/069,571, filed Aug. 24, 2020, entitled "EXPANDABLE WALL BAGS IN SERIES;" U.S. Provisional Patent Application No. 63/105,420, filed Oct. 26, 2020, entitled "POST-EXPANSION PACKAGING;" U.S. Provisional Patent Application No. 63/107,333, filed Oct. 29, 2020, entitled "POST-EXPANSION PACKAGING;" and U.S. Provisional Patent Application No. 63/107,312, filed Oct. 29, 2020, entitled "PACKAGING MATERIAL WEB WITH STRIP SEALS;" each of which is incorporated herein by reference in its entirety.

FIELD OF THE INVENTION

The present disclosure relates generally to packaging for shipping items. More specifically, the disclosure relates to packaging material configured to be produced and packaged in a high-density configuration for later expansion to a low-density configuration.

BACKGROUND

Traditional low-density protective packaging is produced in standard bulky, low-density configurations. These bulky, low-density configurations may include, for example, preformed and inflated fluid chambers (e.g., bubble wrap), pre-expanded foam, the insertion of padding, etc. These bulky, low-density configurations provide packaging support during shipment. Before they can be used in packaging, however, they must be shipped to the packaging and shipment locations.

Since traditional protective packaging is produced already in bulky, low-density configurations, it must be transported as such. This increases the total volume of the packaging material even before it is used for packaging, thus increasing shipping costs of the packaging material to packaging and shipment locations and decreasing the amount of product that can be stored at these locations until use is needed.

For at least these reasons, systems and methods for producing packaging material in a low volume, high-density configuration which can then be expanded at a later time is needed.

SUMMARY

According to various embodiments, a packaging material web stock is provided. The packaging material web stock can include first and second plies overlaid and sealed to each other at a plurality of seals that include a plurality of transverse seals extending transversely across the plies, wherein a plurality of interior cavities are defined between the plies and the transverse seals, the first and second plies arranged in a web that includes a plurality of packaging units arranged longitudinally in a series along the web, wherein the first and second plies form walls of the packaging units, and at least some of the packaging units include at least one of the interior cavities. The packaging material web stock can further include an expansion material disposed in the interior cavities in an unexpanded configuration, the expansion material having a composition to expand into an expanded configuration upon application of expanding conditions, wherein the expansion material is arranged within the inner cavities such that when expanded to the expanded configuration the expansion material is configured to provide cushioning in the walls to an object to be shipped.

According to various embodiments, the web is consolidated in a high-density configuration. According to various embodiments, in the high-density configuration, the web is rolled into a roll. According to various embodiments, in the high-density configuration, the web is folded into a fanfold stack.

According to various embodiments, each of the packaging units includes at least one of the interior cavities.

According to various embodiments, the packaging units are arranged in a repeating series.

According to various embodiments, all of the packaging units are the same.

According to various embodiments, the packaging units are pads that each include a single one of the walls.

According to various embodiments, the walls of each packaging unit include a plurality of said walls overlaid with each other to define an interior cavity therebetween configured to house the object to be shipped. According to various embodiments, the walls are unsealed on a side of the interior cavity to provide an opening into the interior cavity configured for receiving the object into the interior cavity. According to various embodiments, the packaging material web stock includes an opening sealing material disposed on at least one of the walls for sealing the walls together at the opening to seal the opening closed to retain the object in the interior cavity for shipping.

According to various embodiments, the packaging material web stock includes a first sealing material, disposed at the transverse seals, configured to form a seal at the transverse seals upon application of first conditions to the first sealing material. The sealing material at the openings can be a different material than the first sealing material, and can be configured to form a seal at the openings upon application of second conditions to the sealing material at the openings.

According to various embodiments, the overlaid plies include a hinge area disposed for folding the overlaid plies over each other at a hinge line that extends through the hinge area to divide the overlaid plies into first and second wall portions on opposite sides of the hinge line, such that the wall portions are folded about the hinge line to a folded configuration, defining the interior cavity therebetween. According to various embodiments, the expansion material includes an expandable material configured, when in an expanded configuration, to cushion the object, the expandable material being disposed between the first and second plies in a main padding area, wherein the hinge area between the plies has less of the expandable material than in the main padding area such that, in the folded configuration, the hinge area is thinner than the main padding area.

According to various embodiments, the expanding conditions include an expansion temperature sufficient to cause the expansion material to decrease in density and expand to the expanded configuration.

According to various embodiments, the expansion material includes a plurality of materials separated by a barrier, wherein contact between the plurality of materials causes the expansion material to expand.

According to various embodiments, the expanding conditions include a minimum force to be applied to the expansion material, wherein the minimum force is sufficient to cause the plurality of materials to make contact with each other According to various embodiments, the minimum force is sufficient to cause the plurality of materials to mix.

According to various embodiments, the packaging material web stock includes a region of weakness positioned between adjacent packaging units in the series of packaging units, wherein the region of weakness is configured to facilitate separation of the adjacent packaging units.

According to various embodiments of the present disclosure, a system is provided. The system can include a packaging material web stock, and an expansion device configured to apply the expanding conditions to the expansion material when unconsolidated from the high-density configuration.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1:
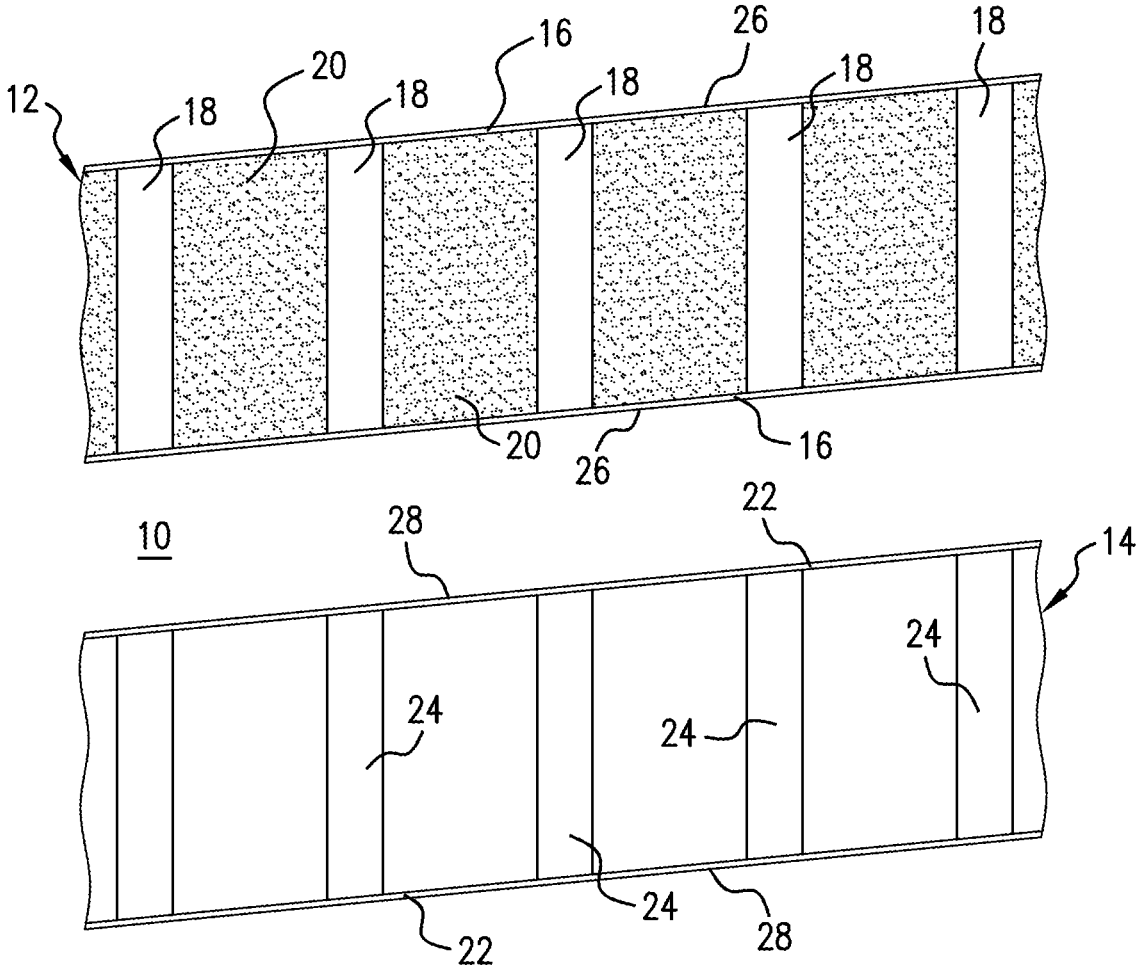
FIG. 1 is a top perspective view of an embodiment of plies used to form a wall.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples can be utilized and other changes can be made without departing from the spirit or scope of the subject matter presented herein. It will be readily understood that the aspects of the present disclosure, as generally described herein and illustrated in the figures, can be arranged, substituted, combined, separated, and designed in a wide variety of different configurations, all of which are implicitly contemplated herein.

Some aspects of the present disclosure are directed to packaging elements formed from packaging material. Some packaging elements formed from the packaging material include pads and sheets, which include a single wall. Some packaging elements formed from the packaging material include packaging units configured to cushion one or more objects during shipping. Packaging units can include, for example, pads and packaging containers. Packaging containers include a plurality of walls enclosing an interior cavity for storing one or more products. Some packaging containers include bags and envelopes, such as mailers, which may be fabricated and then filled with an item to be shipped at a later point in time.

Some embodiments of the present disclosure include expansion walls. Some expansion walls include expandable walls, which are in an unexpanded configuration and can be expanded at a later time. Expansion walls may include one or more expansion members configured to expand the expansion walls. Expansion members may include one or more expansion materials. Some expansion materials include expandable material configured to expand with the application of one or more expansion conditions such as, e.g., heat or chemical reaction, or other suitable means. Some expansion materials include expanded materials having expanded from applied dimensions.

The various seals described herein include at least one sealing material. In a preferred embodiment, a web of packaging material includes a plurality of sealing materials. The sealing material includes a sticking element. The sticking element includes an adhesive or cohesive material to provide an adhesive or cohesive surface, respectively. A combination of adhesive and cohesive surfaces can be used. The sticking element can be applied directly to the exposed surface of the material by suitable known methods, or it can be applied on a tape, such as a double-sided tape, or other suitable methods. In some embodiments, the sealing material includes polyethylene. In some embodiments, the sealing material includes a material which can be heat sealed. In some embodiments, the sealing material includes a material which acts as a cold glue. It is noted that other suitable sealing materials can be used in conjunction with, or alternatively to, the example sealing materials described herein.

As used herein, an adhesive sticking element is made of a material that adheres to other types of surfaces, preferably such as ones that would be typically be found in the vicinity of protective packaging, such as to plastic, paper, or metals. The adhesive can stick to an opposing surface without relying on the opposing surface having the same or a complimentary material for the stickage to take place to form a connection between the two surfaces. Examples of suitable adhesives include liquid adhesives and pressure sensitive adhesives. Pressure sensitive adhesives can be selected that stich after applying a slight, initial, external pressure to create the bond. Examples of these include water-based, acrylic, pressure sensitive adhesives, similar to what is applied to packaging tape, which material holds two surfaces together solely by surface contact, often upon a slight initial external pressure. Examples may include dry adhesives, which typically require no activation with water, solvent or heat, and firmly adhere to many dissimilar surfaces. Pressure sensitive adhesives can be selected that are aggressive and/or permanently tacky at room temperature. Pressure sensitive adhesive application and use can be automated. When used in assembly, pressure sensitive adhesives that do not require setup or long curing times can be used to save time compared to using typical liquid adhesives. Adhesion is preferably immediate with pressure sensitive adhesives, allowing manufacturing procedures to continue uninterrupted, which can result in significant time and labor savings. Examples of water based, acrylic, pressure sensitive adhesives include those known as RHOPLEX N-1031 Emulsion, RHOPLEX N-580 Emulsion, and RHOPLEX N-619 Emulsion. Other emulsion polymers or acrylic polymer blend adhesives are also known, and other suitable types of adhesives and/or contact adhesives can be used.

A cohesive material of a sticking element causes one surface to stick to an opposing surface by coming into contact with the same or a complimentary cohesive substance to form the bond between the two surfaces. Cohesives, in which opposing cohesives stick to one another, do not stick to other substances sufficiently to adhere to those other substances (e.g., other surfaces of the protective packaging material that do not have a cohesive element, surfaces of the container, surfaces of the product to be shipped), or in some cases would stick very weakly compared to the bond they form from sticking to each other. A cohesive can be a pressure sensitive cohesive, in which pressure is required to activate the bond. Examples of a suitable cohesive material from which the cohesive sticking elements can be made include natural and synthetic latex-based cohesives. The cohesive material in some embodiments is applied as a liquid to the appropriate portion of the protective packaging material, and in others is applied in other known forms. Some types of cohesives, such as ones made with latex, is mixed with water without additional adhesives to bond to the respective, non-cohesive, portion of the protective packaging material, and upon drying remains stuck to the exposed surface of the protective packaging material to which is has been applied. In some embodiments, the cohesive material can be mixed with an adhesive, often applied as a liquid, onto the protective packaging material. The adhesive can be selected so that after applying the cohesive and adhesive mixture onto the protective packaging material (e.g., onto a film ply), the adhesive evaporates, leaving the cohesive bonded to the non-cohesive protective packaging material (e.g., onto a film or paper ply). One method of liquid application is spraying, although brushing or other suitable methods can be used. Also, other suitable methods of applying the cohesive to the non-cohesive material surface can alternatively be used.

Referring to FIG. 1, a supply web 10 of packaging material is shown in a low-volume, high-density configuration. The web 10 material includes one or more plies or layers of a polymer, a cellulose-based (e.g., paper), or other suitable material. In FIG. 1, the web 10 forms an expansion wall and includes a plurality of plies 12, 14. A wall is provided as a multi-ply structure. In alternative embodiments, one or more walls are multi-ply and/or single ply structures.

The web 10 includes a first ply 12 and a second ply 14. The first ply 12 includes one or more seals 16, 18 formed or applied thereon, which may include a sealing material. The one or more seals 16, 18 include one or more longitudinal seals 16 adhered along one or more longitudinal edges 26 of the first ply 12. The one or more seals 16, 18 may additionally or alternatively include one or more transverse seals 18. The one or more transverse seals 18 extend to one or more of the longitudinal edges 26 of the first ply 12. In other embodiments, the transverse seals 18 extend across a portion of the first ply 12.

The plies 12, 14 can include paper (e.g., cardboard, kraft paper, fiberboard, pulp-based paper, recycled paper, newsprint, and coated paper such as paper coated with wax, plastic, water-resistant materials, and/or stain-resistant materials), plastic, cellulose, foil, poly or synthetic material, biodegradable materials, and/or other suitable materials of suitable thicknesses, weight, and dimensions. The plies 12, 14 can include recyclable material (e.g., recyclable paper). The plies 12, 14 can include one or more substrates. In some embodiments, the one or more substrates include a paper substrate. The paper substrate can include a material layer applied thereon. The material layer can include one or more of a waterproof layer, an airtight layer, an adhesive layer, a cohesive layer, a heat sealable layer, other suitable material layers, and/or a combination thereof.

The web 10 includes an expandable element. The expandable element includes an expansion material 20. The expansion material 20 can be positioned between the first ply 12 and the second ply 14. The expansion material 20 is applied to one of the plies 12, 14. The expansion material 20 is applied to the first ply 12. In other embodiments, the expansion material 20 is applied to the second ply 14 and/or both the first ply 12 and the second ply 14. The expansion material 20 is applied in regular shapes (for example, circles, ovals, squares, rectangles, triangles, etc.) or in irregular shapes. The expansion material can be applied to the web as a continuous layer or in a pattern. The pattern can be configured such that, when the plies are pressed together, the expansion material spreads out, forming a continuous layer. In some embodiments, the web 10 includes one or more vents or venting openings configured to enable gas (e.g., water vapor) produced by the application or expansion of the expansion material 20.

An expansion device can be provided that causes the expansion material to expand. The expansion device is activated by an expansion initiator. In some embodiments, the expansion material includes a plurality of materials, separated by a barrier, that, when mixed or in contact with each other, causes the expansion material to expand into an expanded configuration. In some embodiments, the expansion material includes a matrix which can be expanded by an expansion device. Prior to expansion of the expansion material, when the expansion material is still in an expandable condition (i.e., when the expansion material is an expandable material), the matrix can be fluid, such as a gel or liquid. This allows ready application onto the plie(s). In other embodiments, the expandable material is provided as a solid, and/or may go through a gel or fluid phase. The expansion initiator can be thermal and/or mechanical and/or chemical and/or can include other suitable initiating properties for activating the expansion device. For example, the expansion initiator can be one or more of heat, pressure, a chemical reaction and/or other suitable expansion initiators. The expansion device can include reactive components, chemical catalysts, blowing agents, heating agents (which can apply heat to the expansion material and/or cause the expansion material to increase in temperature) and/or other suitable expansion devices. In some embodiments, the expansion device is maintained separate from the matrix by a barrier, and for this purpose can be maintained within another structure such as, for example, microsphere shells. The expansion material 20, once expanded, provides a cushion configured to provide protection to one or more items/products/etc. positioned against the first ply 12 or the second ply 14.

In some embodiments, the matrix can include one or more polymers including emulsion-based polymers. The one or more polymers can include one or more of vinyl acetate ethylene, polyvinyl acetate, polyvinyl alcohol, polyvinyl acetate copolymers, polyvinyl alcohol copolymers, dextrin stabilized polyvinyl acetate, vinyl acetate copolymers, ethylene copolymers, vinylacrylic, styrene acrylic, acrylic, styrene butyl rubber, polyurethane, polyolefins, biodegradable materials (e.g., cellulose and starch), and/or other suitable expansion materials.

In some embodiments, the matrix can include a polyolefin based adhesive or a polyolefin dispersion. The polyolefin dispersion can include polyethylene and/or polypropylene, thermoplastic polymers, polymeric stabilizing agents including at least one polar polymer, water, and/or other suitable polyolefin dispersions. A suitable polyolefin dispersion can include, for example HYPOD™, from Dow Chemical, or other suitable polyolefin dispersions.

In some embodiments, the matrix is a water-based adhesive. The water-based adhesive may include a water-based polymer.

In some embodiments, the matrix is based on starch in its natural or synthetic forms. In some embodiments, the starch is in the form of a ground up micro-starch powder. The diameter of the ground up starch particles is between about 12 microns to about 20 microns. In some embodiments, the starch-based matrix comprises one or more of water or other solvent, a surfactant, polar bonding agent, or other fillers. In some embodiments, for example, the matrix comprises up to 50% water. In some embodiments, the matrix comprises 30-40% starch for example.

Some embodiments include a barrier that separates the expansion device from the matrix. A type of suitable barrier is a microsphere shell that contains a blowing agent, chemical catalyst, or chemical reactive component as the expansion device. Other types of barriers can alternatively be used.

In some embodiments, the expansion device comprises a plurality of microspheres that are expandable and/or rupturable, for example upon the application of sufficient heat. The microspheres can include an outer shell and an inner core. Suitable outer shells can include, for example, one or more of a thermoplastic polymer such as polyacrylonitrile or PVC, as well as glass, rubber, starch, cellulose, ceramic, or other suitable material. In some embodiments, the plurality of heat-expandable microspheres include a solid, liquid or gas core made from one or more of a hydrocarbon, water, or other suitable chemical that can be activated to expand or rupture the microsphere shell. In some embodiments, the microspheres can include biodegradable materials such as, for example, cellulose.

The device, such as the microspheres, can be mixed with the matrix prior to application on the web, or provided on the matrix after the matrix has been applied to the web, by mixing or forcing the microspheres into the matrix after application to the web, for example when the plies are pressed together.

In some embodiments, the microspheres have an expansion temperature (Texp), at which the microspheres begin to expand, and a maximum temperature (Tmax), whereby, if the microspheres are heated above Tmax, they will rupture. The Texp of the microspheres is not particularly limited, but is generally between about 60° C. and up to about 250° C. The Tmax of the microspheres is generally between about 80° C. and up to about 300° C. In some embodiments, the Tmax is higher than 300° C. The microspheres are selected based on their maximum expansion temperature, depending on whether the microspheres are required to rupture or not. The Tmax is dependent on several properties, including the physical properties of the microspheres, the physical properties of the matrix, as well as the physical properties of the plies on which the matrix and microspheres are deposited. The heat can be generated via suitable means such as, for example, radiofrequency radiation or other suitable means. In some embodiments, the radiofrequency radiation is applied to the expansion material 20 at frequencies of approximately 10-45 MHz or as appropriate for the microsphere composition and the material of the matrix. In other embodiments, other frequencies may be used. The heating parameters selected are dependent upon the expansion material or materials 20 used. Suitable microspheres are known in the art.

In some embodiments, the expansion device includes a blowing agent such as a gas or a mixture of gases. Examples of suitable gases include air, carbon dioxide, nitrogen, argon, helium, methane, ethane, propane, isobutane, n-butane, neopentane, and the like. In some embodiments, the gas or mixture of gases are added to the expansion material by mechanical means. Examples of mechanical means include whisking or frothing the expansion material to beat the air or other gases into the expansion material and increase its volume. In other embodiments, the gas or mixture of gases can also be encapsulated in microspheres. When the microspheres are activated, they expand and may rupture. The expansion of the microspheres causes expansion of the expansion material. The rupture of the microspheres releases their contents, resulting in foaming and expansion of the expansion material. In some embodiments, the web 10 includes one or more vents or venting openings configured to enable gas (e.g., water vapor) produced by the application or expansion of the expansion material 20.

In some embodiments, the expansion device includes one or more reactive components which cause chemical reactions to expand the matrix. Chemical reactions can include the mixing of two reactive components, that react to generate a foam. In some embodiments a catalyst is used to increase the rate of the chemical reaction. In some embodiments, the two reactive components are separated by a barrier prior to mixing and expansion. The barrier separating the reactive components can be the shell of a microsphere, wherein the core of the microspheres comprises one or more reactive components, and rupturing of the microsphere releases its contents into one or more other reactive components, causing a foam generating reaction. Other barriers may also be used such as walls, capsules, or other barrier forming containers. Examples of reactive components that cause expansion include mixing a liquid form of isocyanate with a multi-component liquid blend called polyurethane resin. When combined, these components release carbon dioxide and water vapor to generate a polyurethane foam. Other reactive components can be used that form a foam upon mixing.

In some embodiments, when the expansion material 20 is expanded solidifies, although other in embodiments, the expansion material 20 forms a gel or has another physical phase depending on the construction of the article. The expanded expansion material 20 is configures to form a region of protective padding and/or insulation. The method of solidification of the expansion material is selected based on its physical properties, and may be achieved by such methods as thermosetting, drying (such as air drying), curing, or by other suitable processes, such as know methods to transition a material from fluid to solid. For example, a thermoset plastic may be irreversibly solidified by curing, whereas solidification of a thermoplastic can be reversible.

In some embodiments the expansion material 20 is applied in a pattern. The pattern, distribution, and/or concentration of the expansion material 20 are selected to attain desired padding and/or insulative characteristics. In this embodiment, the expansion material 20 is applied in a pattern of dots. The dots can be dots, squares, circles, large and/or small shapes or polygons. Other suitable patterns can alternatively be employed, such as, for example, lines, arcs, circles, ellipses, squares, rectangles, polygons, or a combination thereof. The expansion material 20 is applied over a part of a surface of one or more of the plies 12, 14 of the web 10. Alternatively, the expansion material 20 can be applied over all of the surface of one or more of the plies 12, 14. In this embodiment, the expansion material is applied in a relatively uniform thickness. Other thicknesses, such as variable thicknesses can alternatively be employed. In some embodiments, lines of the web 10 can be left free of expansion material 20 to form natural hinge lines or regions that are more easily bent than other regions in which the expansion material 20 is expanded. In some embodiments, pressure is applied to the expansion material 20 during or subsequent to expansion, forming hinge lines or regions that are more easily bent than other regions.

The second ply 14 includes one or more seals 22, 24 including a sealing material. The one or more seals 22, 24 may be configured to compliment the seals 16, 18 of the first ply 12, and include one or more longitudinal seals 22 adhered along one or more longitudinal edges 28 of the second ply 14. The one or more seals 22, 24 of the second ply 14 include one or more transverse seals 24. The one or more transverse seals 24 extend to one or more of the longitudinal edges 28 of the second ply 14. In other embodiments, the one or more transverse seals 24 extend across a portion of the second ply 14.

Figure 2:
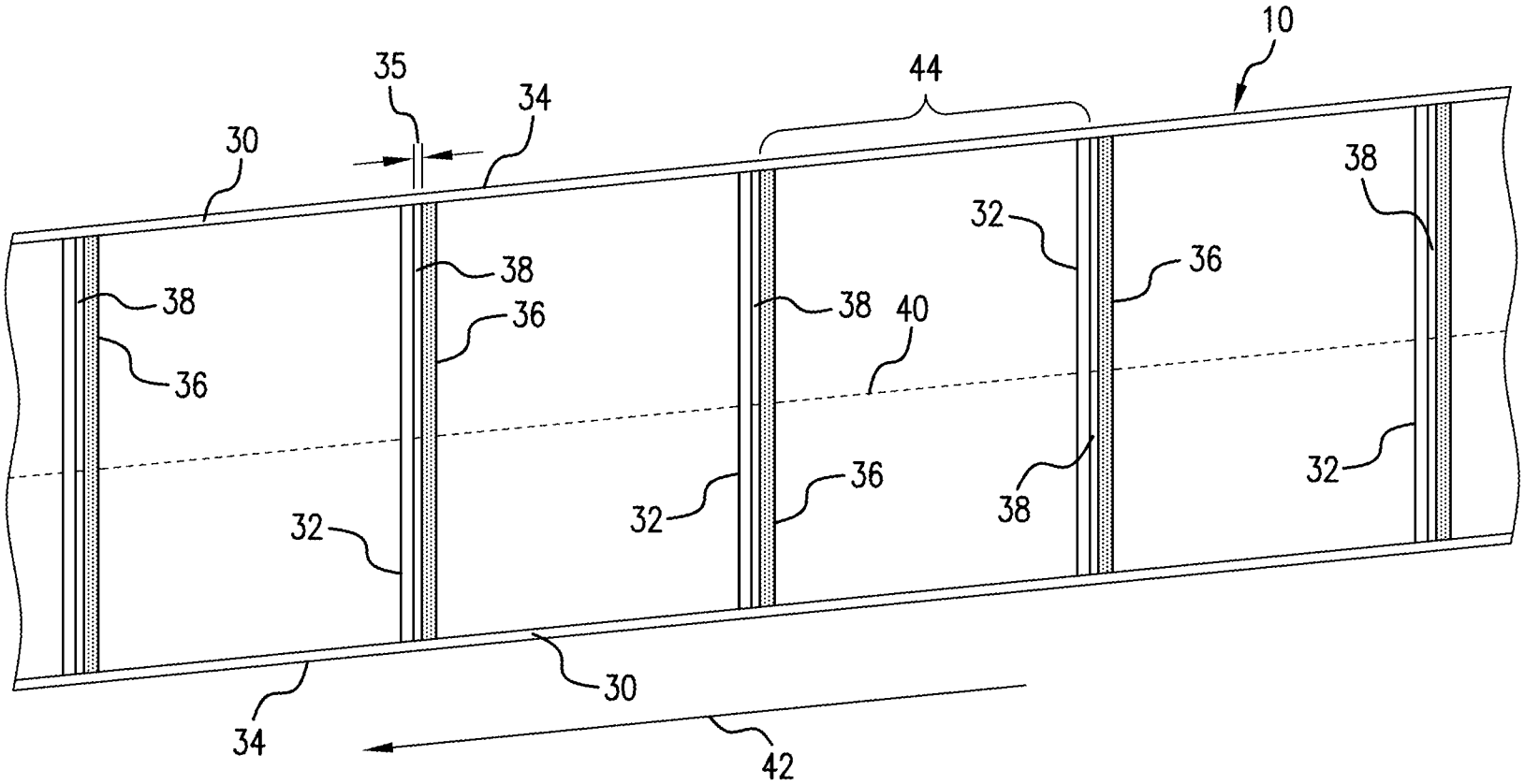
FIG. 2 is a top view of a web of the wall formed, for example with the plies of FIG. 1.
Figure 5:
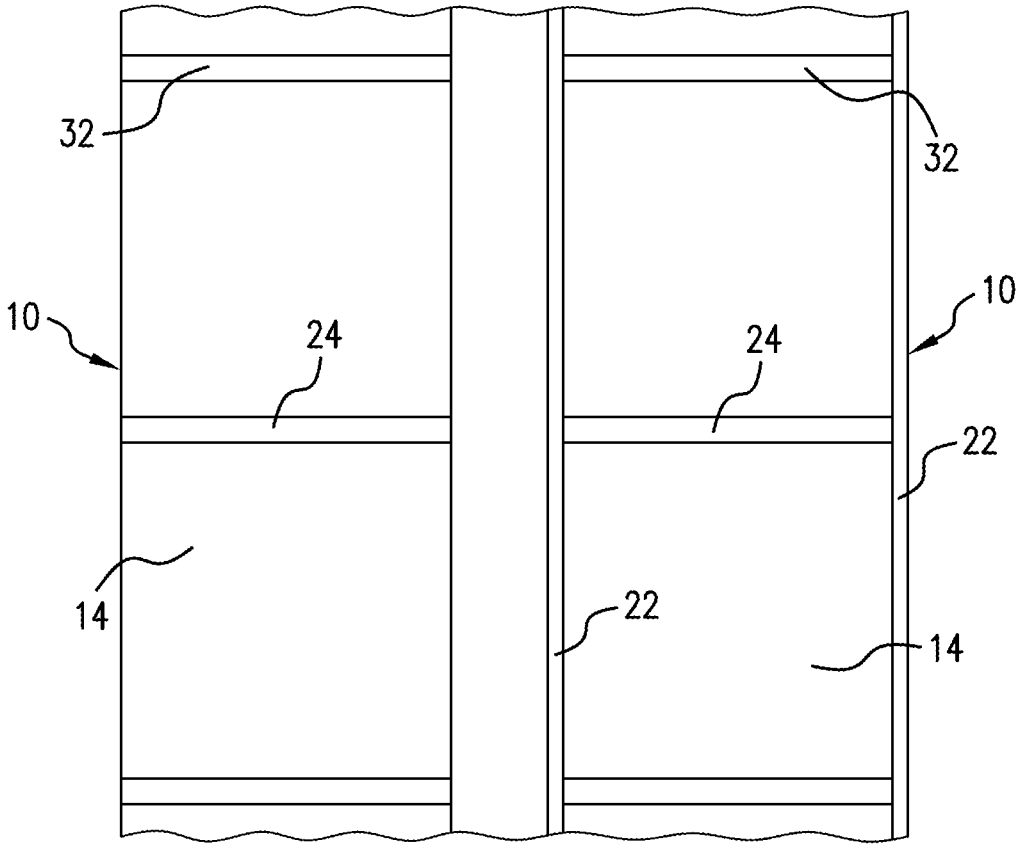
FIG. 5 top view of packaging walls, for example the walls of FIG. 1, used to form a packaging container according to an embodiment.

The first ply 12 is joined to the second ply 14. After the first ply 12 and the second ply 14 are joined, one or more exterior sealing materials are applied to the exterior of the web 10, forming one or more exterior seals 30, 32, 36 (as shown in FIG. 2). One or more longitudinal seals 30 are applied to the outer longitudinal edges 34 of the web 10, and one or more transverse seals 32 are applied between the one or more longitudinal seals 30. The web 10 is then fed, in direction 42 (as shown in FIG. 5), through a folding apparatus which folds the web 10. In this embodiment, the web 10 is folded along a folding edge 40. In other embodiments, the web alternatively has a plurality of folding edges 40.

The web 10 may include one or more exterior longitudinal seals 30 and one or more transverse seals 32, 36. Transverse seals 32 form the bottom seal of one or more packaging containers 44. In this embodiment, transverse seals 36 are configured to seal closed an opening in the packaging container 44 subsequent to a product being inserted into an interior cavity of the packaging container 44. According to this embodiment, transverse seals 32, 36 are of differing seal types. In this embodiment, one or more of transverse seals 32, 36 are of a different seal type as the one or more longitudinal seals 30. In other embodiment, one or more of transverse seals 32, 36 are alternatively of a similar seal type as the one or more longitudinal seals 30. According to some embodiments. The one or more longitudinal seals 30 can, in some embodiments, form a seal at a temperature different from a temperature required to form a seal using the one or more transverse seals 32, 36. This enables seals that are activated at one temperature to be activated at a time different from an activation time of one or more seals that are activated at other temperatures. In some embodiments, each of seals 30, 32, and 36 can be heat-activated seals.

The web 10 may include one or more web layers having a surface that includes first and second regions, wherein, when corresponding first regions (corresponding, e.g., in FIG. 2, to the regions upon which seals 30, 32 are positioned) are overlaid with each other and corresponding second regions (corresponding, e.g., in FIG. 2, to the regions upon which seals 36 are positioned), are overlaid with each other, the overlaid first and second regions cooperatively surrounding a cavity defined between the at least one web layer. The web 10 may include a first sealing material disposed in the first region and configured to seal together the corresponding first regions of the at least one web layer upon application of first conditions to the first sealing material. The web 10 may include a second sealing material disposed in the second region and configured to seal together the corresponding second regions of the at least one web layer upon application of second conditions to the second sealing material. The second sealing material is configured such that the first conditions applied to the second sealing material are insufficient to cause the second sealing material to seal. In some embodiments, the first and second sealing materials are different materials. The corresponding first regions are sealed to each other by the first sealing material, and the second sealing material is in an unsealed condition, forming an opening to the interior cavity 46, the opening being configured to receive the object into the interior cavity. In some embodiments, the second sealing material is configured to seal closed the opening. In some embodiments, the corresponding first regions are sealed to each other and the corresponding second regions abut each other. In some embodiments, the at least one web layer includes a longer web layer and a shorter web layer, the second region of the longer web layer is positioned on the longer web layer in a direction facing the interior cavity, and the second region of the shorter web layer is positioned on the shorter web layer in a direction facing outwardly from the interior cavity.

In some embodiments, the one or more longitudinal seals 30 and the one or more transverse seals 32, 36 include sealing material configured to establish a seal without the application of heat. For example, the one or more longitudinal seals 30 and the one or more transverse seals 32, 36 include a pressure-activated adhesive, a cold glue (e.g., a collagen-based glue, a Polyvinyl Acetate-based glue, or other suitable glues), and/or other suitable sealing materials. This prevents the expansion material 20 from activating and expanding while activating either the one or more longitudinal seals 30 and/or the one or more transverse seals 32, 36.

In this embodiment, the one or more transverse seals 32, 36 are provided at longitudinally spaced apart locations of the web 10 and extend substantially fully transversely across the web 10 between the longitudinal edges 34 of the web 10. In other embodiments, one or more of the transverse seals 32, 36 alternatively extend over a portion of the transverse length of the web 10. Transverse seals 32, 36 are separated by a gap 38 separated by distance 35. According to some embodiments, the gap 38 is configured to act as a vent in order to vent one or more gasses produced via the expansion process of the expandable element.

Figure 3:
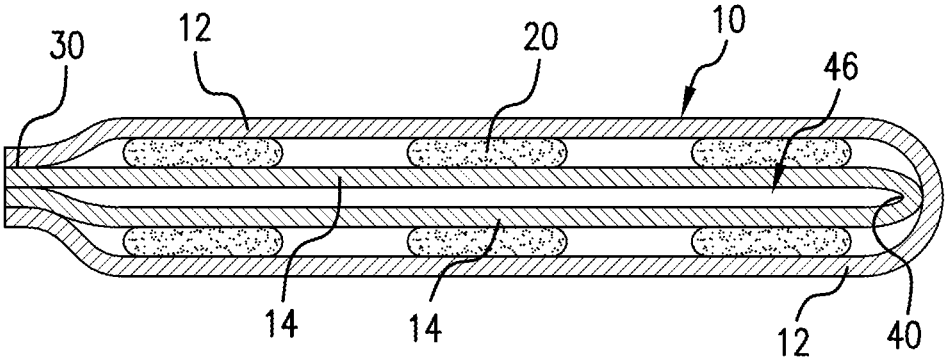
FIG. 3 is a cross-sectional longitudinal view of a web, for example the web of FIG. 2, folded over and bonded to form a web of connected packaging containers according to an embodiment.

As shown in FIG. 3, a cross section of a folded web 10 is illustratively depicted, in accordance with various embodiments of the present disclosure. The web 10 is folded over, at folding edge 40, forming a bag formation having an interior cavity 46. One side of the folded web 10 is folded over, while the other is sealed via a longitudinal seal 30, forming a seam. The longitudinal seals 30 includes heat activated seals (e.g., heat activated adhesive or other suitable heat-activated seals), one or more strip-seals, one or more pressure activated-seal such as, for example, pressure-activated adhesive or other suitable types of pressure-activated seals, or other suitable types of seal. The sealing material may be applied to a perimeter. In some embodiments, the sealing material has an approximately uniform width. In some embodiments, the sealing material is applied with varying widths. The web 10 can have one folding edge 40 or, alternatively, a plurality of folding edges 40.

Once folded and flattened, the longitudinal seals 30 are aligned. In some embodiments, the seals 30 are aligned at a longitudinal edge 34 of the web 10, as shown in FIG. 3. In other embodiments, the seals 30 are aligned at a position between a plurality of folding edges 40, forming a seam 48 at unfolded web longitudinal edge 34, as shown in FIG. 4. The web 10 includes one or more regions of weakness 50 that extend transversely (e.g., generally perpendicularly) to the longitudinal edges 34. Seam 48 includes a longitudinal edge 34 overlapping another longitudinal edge 34, wherein sealing material is applied to an upper region of one longitudinal edge and/or a lower region of the other longitudinal edge, enabling the seal 48 to be formed. In some embodiments, seal 48 can be a fin seal or other suitable seal configuration.

In this embodiment, the one or more transverse seals 32 are provided at longitudinally spaced apart locations of the web 10 and extend substantially fully transversely across the web 10 between the longitudinal edges 34 of the web 10. In other embodiments, one or more of the transverse seals 32 extend over a portion of the transverse length of the web 10.

Figure 4A:
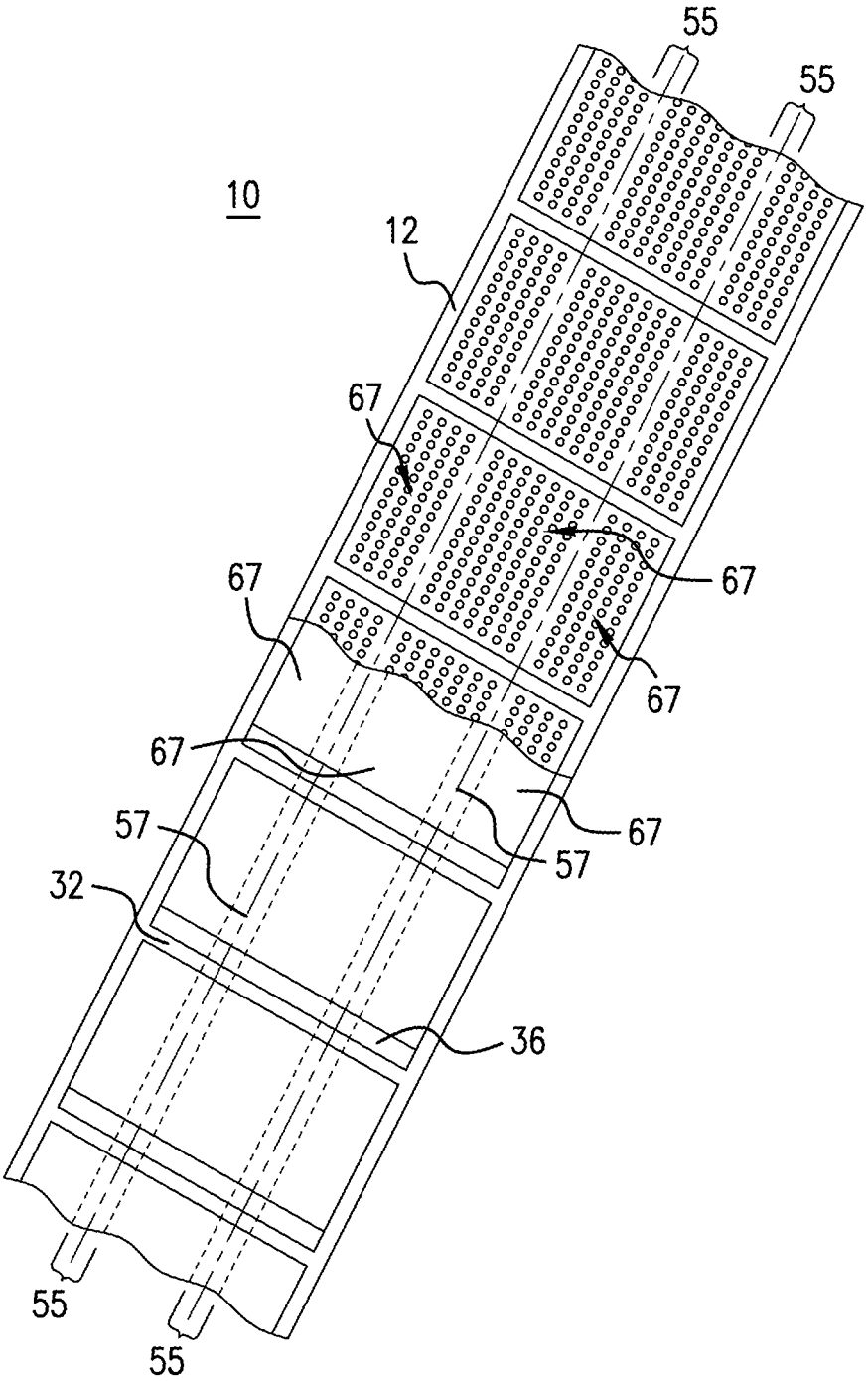
FIG. 4A is a top cutaway-view of another embodiment of a web.
Figure 4B:
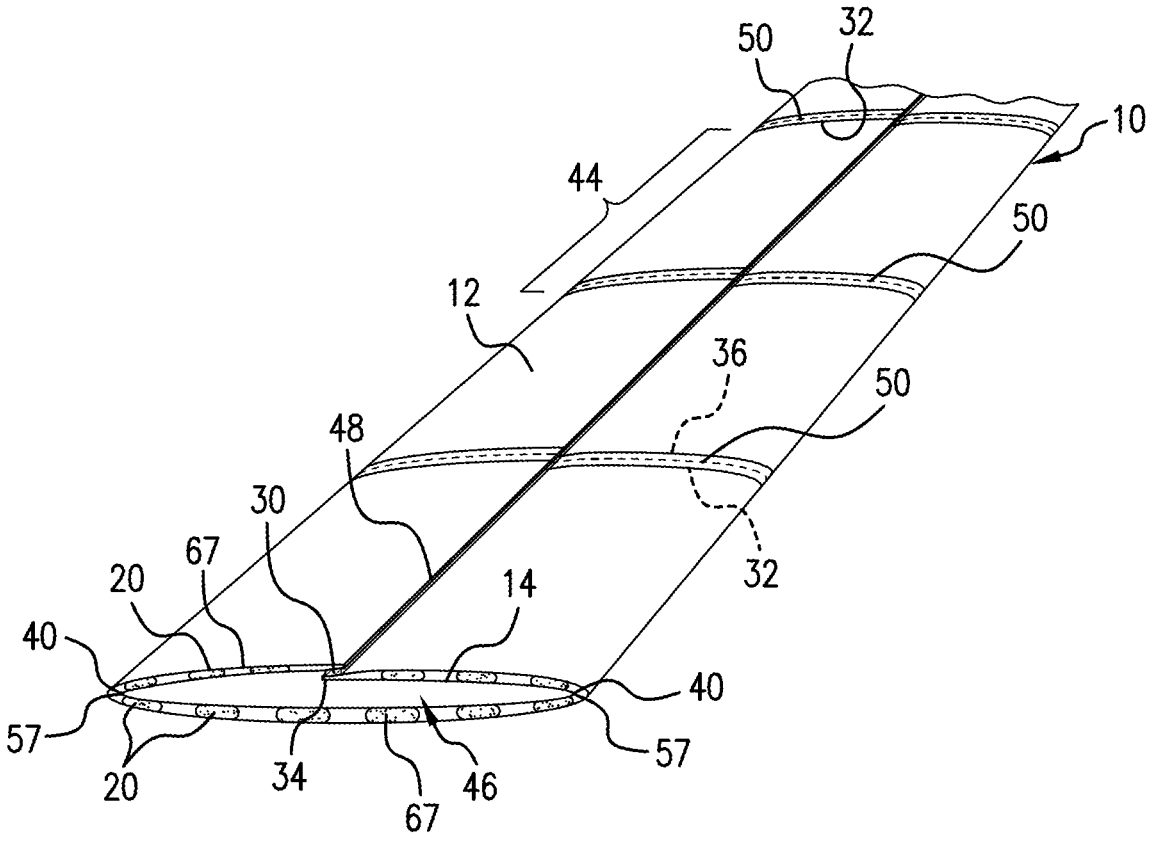
FIG. 4B is a bottom perspective view of a web of FIG. 4A, folded over and bonded to form a web of connected packaging containers.
Figure 4C:
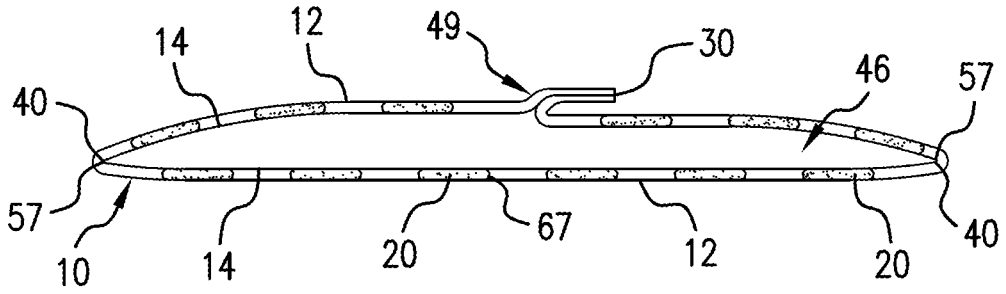
FIG. 4C is a cross-sectional longitudinal view of the web of FIG. 4B.

As shown in FIG. 4A-4C, the packaging material web includes first and second overlaid plies 12, 14 including a hinge area 55 disposed for folding the overlaid plies over each other at a hinge line 57 that extends through the hinge area 55 to divide the overlaid plies into first 61 and second 63 wall portions on opposite sides of the hinge line, such that the wall portions are folded about the hinge line 57 to a folded configuration, defining an interior cavity 46 therebetween, the interior cavity being configured to receive and house an object. In some embodiments, the packaging material web includes an expandable material configured, when in an expanded configuration, to cushion the object. The expandable material is disposed between the first and second plies in a main padding area 67, wherein the hinge area between the plies has less of the expandable material than in the main padding area 67 such that, in the folded configuration, the hinge area is thinner than the main padding area. The web further includes a sealing material disposed to affix the wall portions in the folded configuration such that the first and second walls define a packaging unit. In some embodiments, the web further includes a longitudinal seal material. In some embodiments, one or both of the longitudinal edges are sealed.

In some embodiments, the hinge area 55 is substantially free of the expandable material, providing a gap 59 between portions of the main padding area 67 on the first and second wall portions 61, 63. In some embodiments, the hinge area 55 includes less than 30% the amount of expandable material as the main padding area 67. In some embodiments, the hinge area 55 includes less than 25% the amount of expandable material as the main padding area 67. In some embodiments, the hinge area 55 includes less than 10% the amount of expandable material as the main padding area 67. In some embodiments, the hinge area 55 has no expansion material. In some embodiments, the hinge area 55 is a longitudinal strip having a width. However, the hinge area 55 may have one or more other suitable shapes.

In some embodiments, the first and second overlaid plies include a third wall portion 65, and the hinge area includes a first hinge area disposed between the first and second wall portions, and a second hinge area disposed between the second and third wall portions, such that the first and third wall portions folded respectively about hinges in the first and second hinge areas each overlays the second wall portion, such that the second wall portion forms a first wall of a packaging container, and the first and third wall portions form a second wall of the packaging container overlaid on the first wall and defining the interior cavity between the walls. The sealing material is disposed to seal the first wall to the third wall. In some embodiments, the first and third wall portions have longitudinal edges such that, in the folded configuration, the longitudinal edges are disposed above the second wall portion and are sealed together by the sealing material. In some embodiments, the second wall portion has a transverse width between the hinge lines, and the first and third wall portions cumulatively have a cumulative transverse width that is at least as wide as the transverse width of the second wall portion.

As shown in FIGS. 4A-4C, in some embodiments, the hinge areas extend longitudinally, the overlaid plies include edges extend longitudinally, and the sealing material is disposed to seal the edges together in the folded position.

In some embodiments, the first and second wall portions each form one wall. In some embodiments, the first and second wall portions each include a longitudinal edge, and the sealing material is disposed to affix the wall portions along the longitudinal edges of the first and second wall portions.

Figure 6:
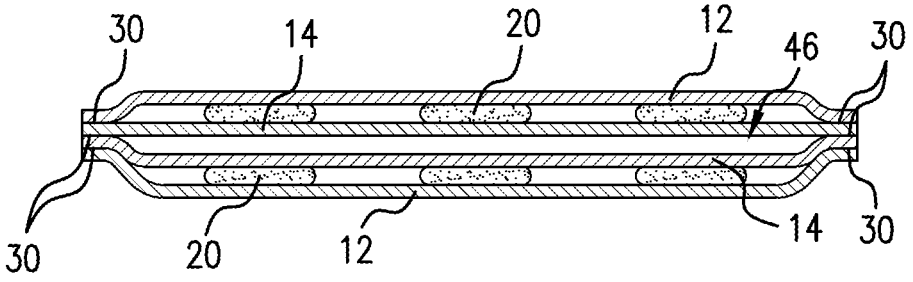
FIG. 6 is a cross-sectional longitudinal view of a packaging container formed from the walls of FIG. 5.

As shown in FIGS. 5-6, a plurality of longitudinal seals 30 are configured to seal together the plurality of webs 10. According to this embodiment, the packaging containers 44 are formed by sealing together a plurality of webs 10, rather than folding over a singular web 10.

Figure 7:
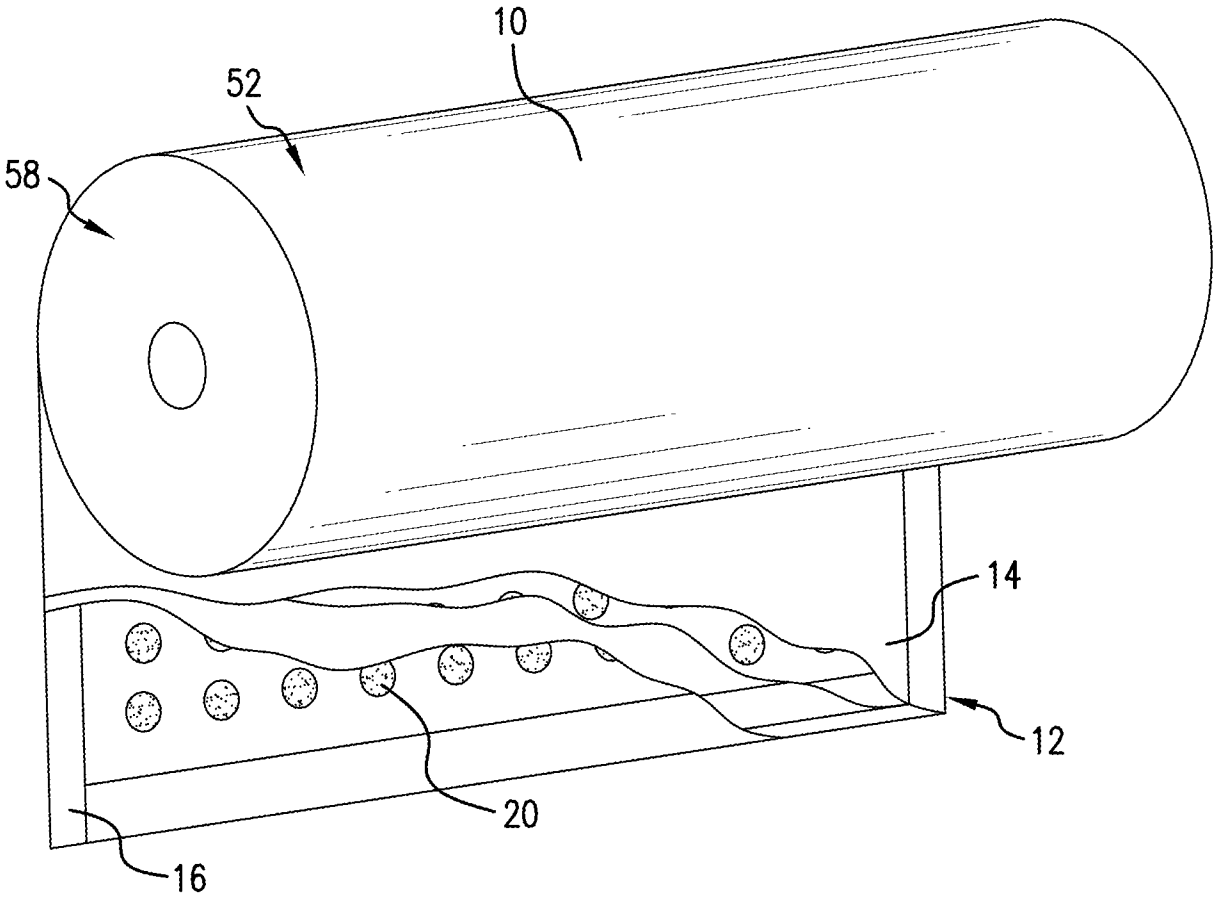
FIG. 7 is a perspective view of a completed, rolled supply web of separable packaging containers, constructed for example as shown in FIG. 6.
Figure 8:
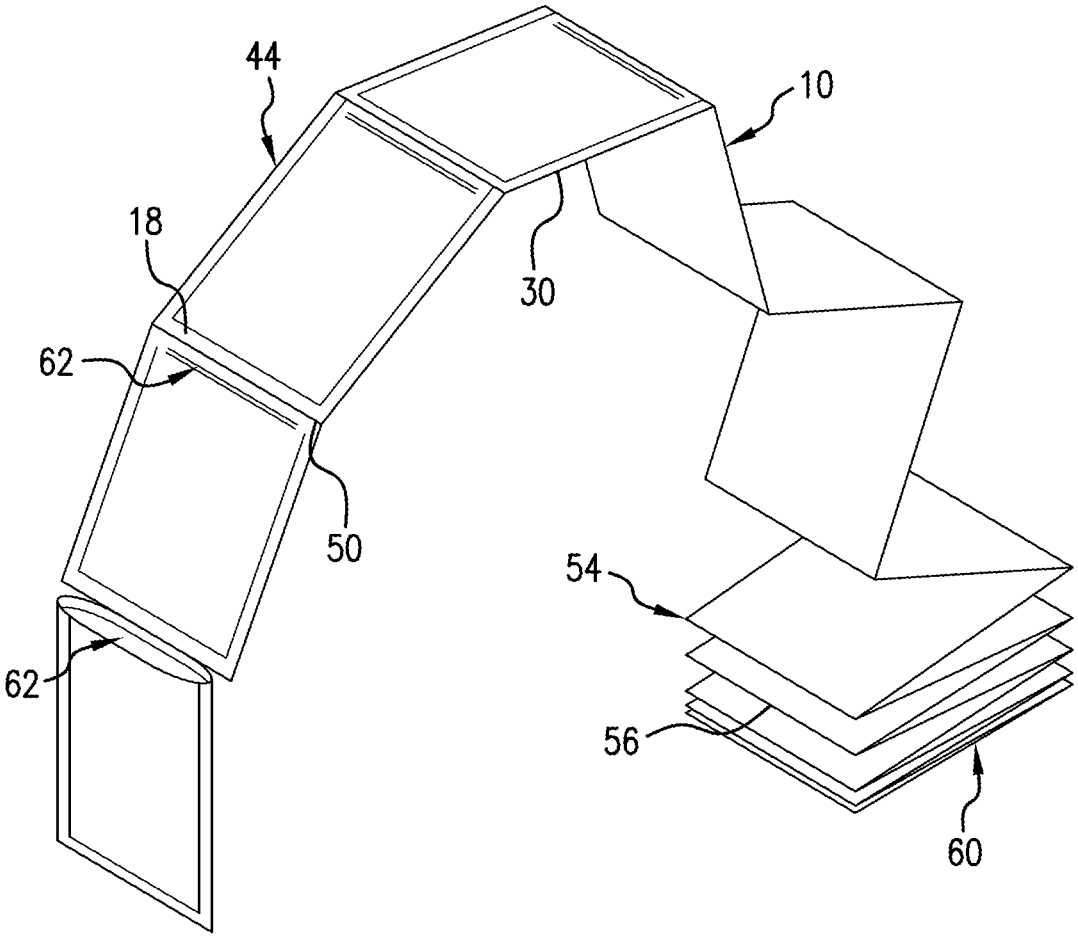
FIG. 8 is a perspective view of a completed supply web of separable packaging containers, constructed for example as shown in FIG. 6, in a fanfold configuration.

Once the web 10 of packaging material is formed, the web 10 is consolidated in an unexpanded, high-density supply configuration, forming a web stock. According to some embodiments, the unexpanded, high-density supply configuration can be rolled into a supply roll configuration 52, such as is illustratively depicted in FIG. 7. The roll configuration 52 can be a cored roll configuration or coreless roll configuration. Another suitable high-density supply configuration is obtained by folding the web 10 into a fanfold stack configuration that has opposing folds 56, such as a fanfold (e.g., accordion) configuration 54 (such as is illustratively depicted in FIG. 8), and/or other suitable configurations. Another suitable high-density supply configuration is a series of 2 or more stacked packaging units. As shown in FIG. 8, prior to consolidation, the web 10 is folded into a series of preformed packaging containers 44. The web 100 can be in a high-density supply configuration 58 (as shown in FIG. 7), wherein an expandable wall formed by the web 100 is compacted in an unexpanded configuration. According to other embodiments, the web 10 can be in a high-density packaging container configuration 60 (as shown in FIG. 8), wherein one or more expandable walls are configured into the series of preformed packaging containers 44 and condensed into an unexpanded, high-density configuration.

Figure 9A:
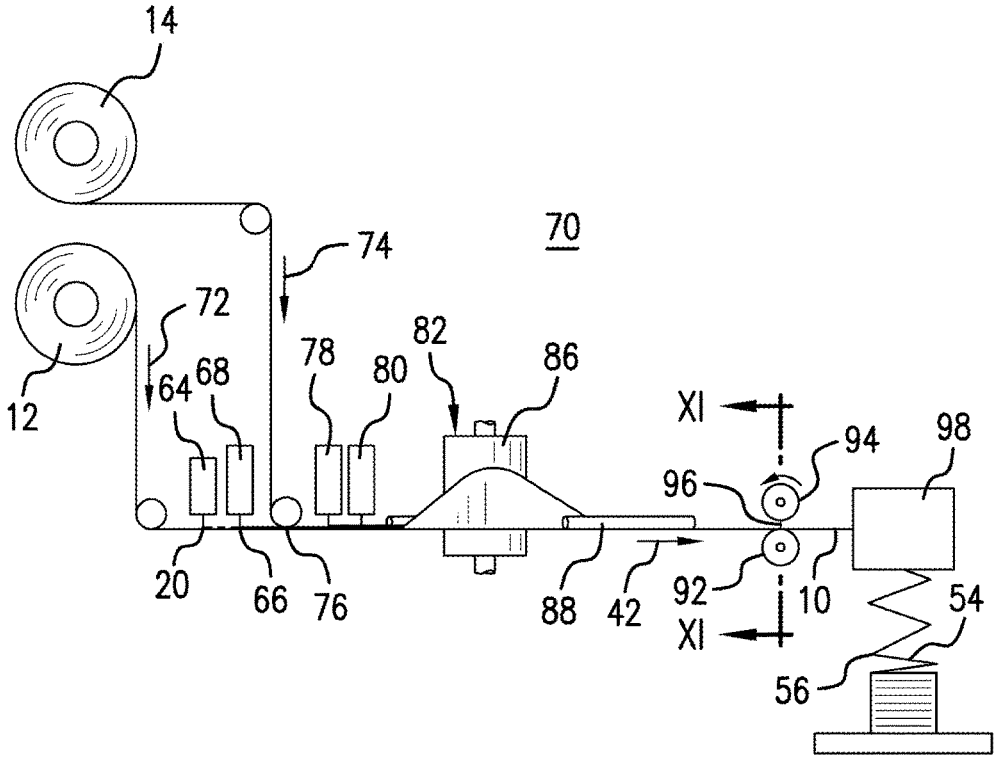
FIGS. 9A and 9B are side and top views, respectively, of a system for converting stock material into supply chain of separable packaging containers constructed, for example as shown in FIG. 3.
Figure 9B:
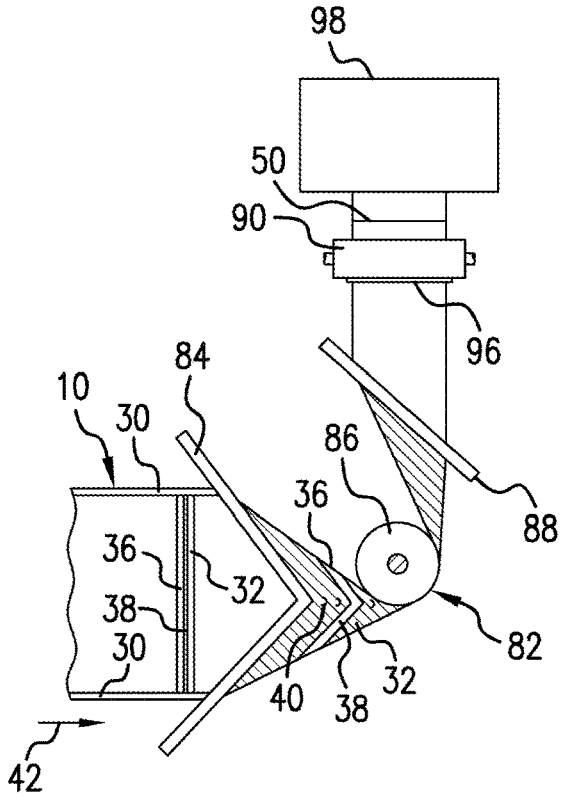

Referring to FIGS. 9A-9B, a system 70 for converting stock material into supply chain of packaging containers is shown. The web 10 includes a first ply 12 and a second ply 14. The first ply 12 is fed, in direction 72, and the second ply 14 is fed, in direction 74, and the first ply 12 is joined to the second ply 14. An expansion material 20 is applied to the first ply 12, using an expansion material applicator 64, and one or more sealing materials 66 are applied to the first ply 12, using a sealing material applicator 68. After the expansion material 20 and the sealing material 66 are applied, the first ply 12 and the second ply 14 are joined. The joining can include applying pressure using a pressure applicator 76 configured to apply pressure to the first ply 12 and the second ply 14.

After the first ply 12 and the second ply 14 are joined, one or more exterior sealing materials are applied to the exterior of the web 10, forming one or more exterior seals 30, 32 (shown in further detail in FIG. 2). One or more longitudinal seals 30 are applied to the outer longitudinal edges 34 of the web 10, using a longitudinal seal applicator 78, and one or more transverse seals 32, 36 are applied between the one or more longitudinal seals 30, using a transverse seal applicator 80. The web 10 is then fed, in direction 42, through a folding apparatus 82 which folds the web 10.

The folding apparatus 82 includes folding mechanism 84 (for example, a folding bar 84). A tension mechanism 86 (for example, a wheel 87) applies tension to the web 10, causing the folding bar 84 to fold the web 10 along the shape of the folding bar 84. The folding mechanism 84 can be a V-shaped folding bar or other suitable folding shape. For example, in some alternative embodiments, the folding mechanism 84 includes a plurality of bends.

The web 10 is folded along folding edge 40. The folding apparatus 82 includes a flattening mechanism 88 configured to flatten the web 10 once folded by the folding mechanism 84. The flattening mechanism 88 is a flattening bar configured to apply pressure to, and flatten, the web 10. The web 10 is then sealed along the one or more longitudinal seals 30, using a sealing apparatus. The flattening mechanism functions 88 can function as a sealing apparatus. In other embodiments, the system 70 can alternatively incorporate a separate sealing apparatus. The sealing apparatus is configured to apply heat, pressure, and/or other suitable means of activating the one or more longitudinal seals 30.

The system 70 includes a cutting apparatus 90. The cutting apparatus 90 is configured to form one or more regions of weakness 50 and an opening 62 in the web 10. The one or more regions of weakness 50 are configured to aid in separating the web 10 into one or more separate packaging elements (e.g., one or more packaging containers). The opening 62 is configured to enable access an interior cavity 46 of each of the one or more packaging containers 44. The opening 62 can be a slit. In other embodiments, the opening 62 is not completed cut open by the cutting apparatus 90 and is configured to be torn open. It is noted that the one or more regions of weakness 50 and/or the opening 62 can be formed prior to or subsequent to consolidation of the web 10. The cutting apparatus 90 includes an upper compression roller 92 and a lower compression roller 94. The upper compression roller 92 includes a series of teeth 96 configured to puncture the web 10, forming a region of weakness 50 transverse to the longitudinal edges of the folded web 10. The lower compression roller 94 can include a rigid surface, an elastomer, or other suitable material. In some embodiments, the cutting apparatus includes one or more blades, heat-cutters, and/or other suitable means of cutting one or more portions of the web 10.

The web 10 includes one or more regions of weakness 50 that extend transversely (e.g., generally perpendicularly) to the longitudinal direction at one or more of the longitudinal edges. In other embodiments, the regions of weakness 50 are alternatively placed elsewhere along the transverse direction of the web 10. The regions of weakness 50 can be provided by perforation, scoring, or other suitable technique for weakening the material at the desired locations such as to make separation of the individual envelope sections easier. A region of weakness 50 can be provided between each pair of adjacent packaging container formations 44, thereby allowing the individual packaging container formations 44 to be separated. The regions of weakness 50 can be provided within the perimeter of transverse seals 32, 36. The regions of weakness 50 can be through both plies 12, 14, or, alternatively, through one ply. The web 10 can include one or more slits configured to aid in the separation of adjacent packaging container formations 44.

In order to prevent the expansion material 20 from escaping from a packaging container formation 44 (particularly when chemical reactions are used to expand the expansion material), the transverse seals 18 of the first ply 12 and the transverse seals 24 of the second ply 14 can be positioned such that they encompass a region before and after the regions of weakness 50. The web 10 can include one or more slits at the longitudinal edges of the web 10 to aid in separation.

The system 70 includes a consolidating apparatus 98 configured to consolidate the web 10 into an unexpanded, high-density configuration such as, e.g., a roll configuration 52, a fanfold stack configuration 54, and/or other suitable configurations. The consolidation apparatus 98 is configured to bend, roll, and/or otherwise alter the shape of the web 10 into the consolidated, unexpanded, high-density configuration.

It is noted that the expansion material 20 and/or the sealing material 66 can be applied to the first ply 12 and/or the second ply 14. It is also noted that the web 10 can include a suitable expansion wall configuration and materials as herein described.

Figure 10:
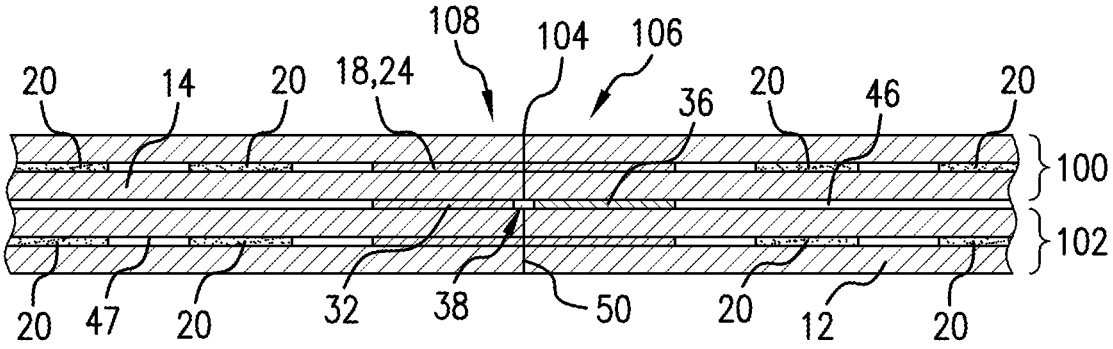
FIG. 10 is a cross-sectional side view across showing a region of weakness in a web of separable packaging containers constructed, for example, as shown in the above figures.

As shown in FIG. 10, the web 10 includes a first bag wall 100 and a second bag wall 102. The walls include wall cavities 47 into which the expansion material 20 is housed. The first bag wall 100 can include a cut 104 configured to enable access to an interior cavity 46 of the packaging container formation 44, while the second bag wall 102 includes a region of weakness 50 configured to enable separation of a top 106 of one packaging container formation 44 from a bottom 108 of a subsequent packaging container formation 44. The opening 46 is sealed along seal 36. In some embodiments, seal 36 includes a sealing material different from the sealing material of seal 32. In some embodiments, when seal 32 is formed, seal 36 remains unformed until after the object is placed within the interior cavity.

Figure 11:
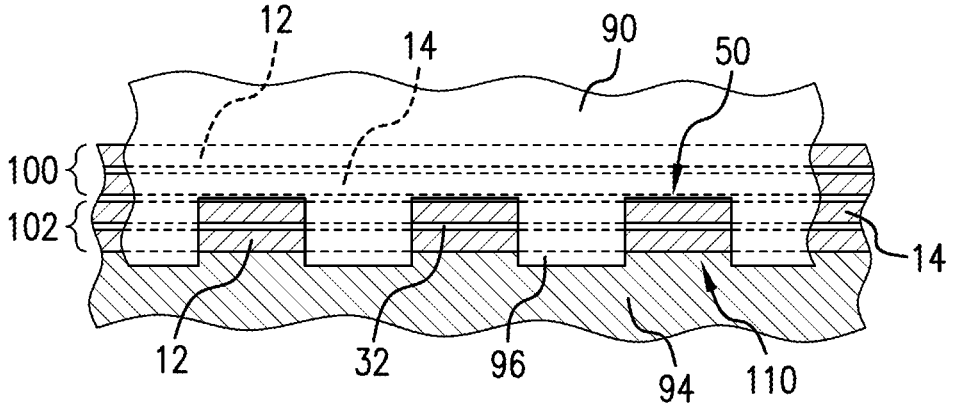
FIG. 11 is a cross-sectional longitudinal view along section plane XI-XI of FIG. 9A.

As shown in FIG. 11, the cutting mechanism 90 can be configured to cut through the first bag wall 100 while the teeth 96 of the cutting mechanism 90 perforate the second bag wall 102. There are recesses 110 between the teeth 96 configured to enable perforations 50 to form. The cutting mechanism 90 forms an opening 62 configured to enable access to the interior cavity 46 of the bag. In some embodiments, the cutting mechanism 90 is configured to form the opening 62 over the region of weakness 50. In some embodiments, the cutting mechanism 90 is configured to form the opening 62 adjacent to the region of weakness 50. In some embodiments, the cutting mechanism 90 is configured to form the opening 62 displaced a distance 35 from the region of weakness 50, forming a gap 38 between the opening 62 and the region of weakness 50 (as shown in FIG. 2).

Once the web 10 is consolidated, it is fed through a protective packaging machine, such as those shown in FIGS. 12-13 and 15A-15B.

Figure 12A:
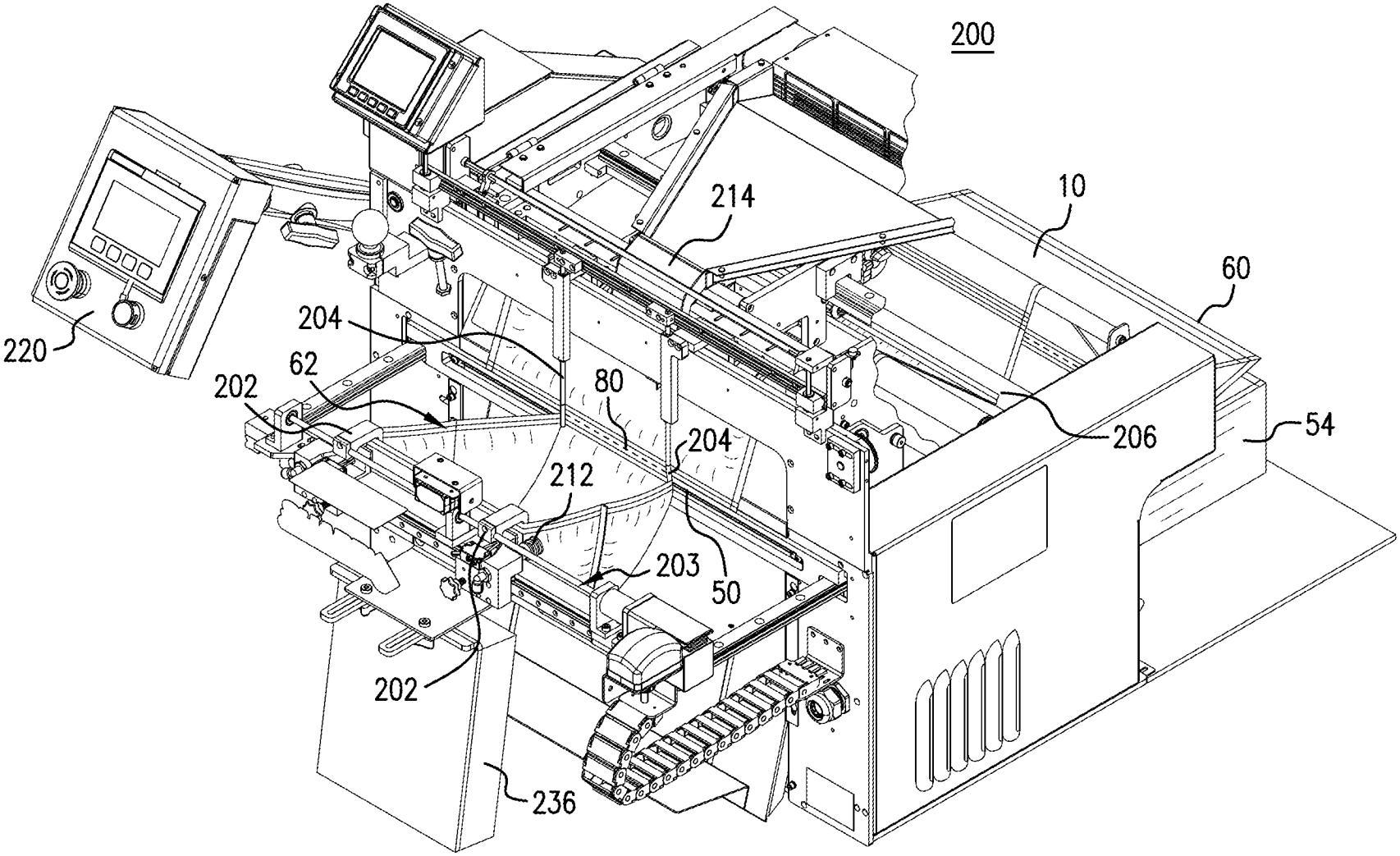
FIGS. 12A and 12B are a perspective and cross-sectional side view of an expansion and bagging device in accordance with an embodiment.
Figure 12B:
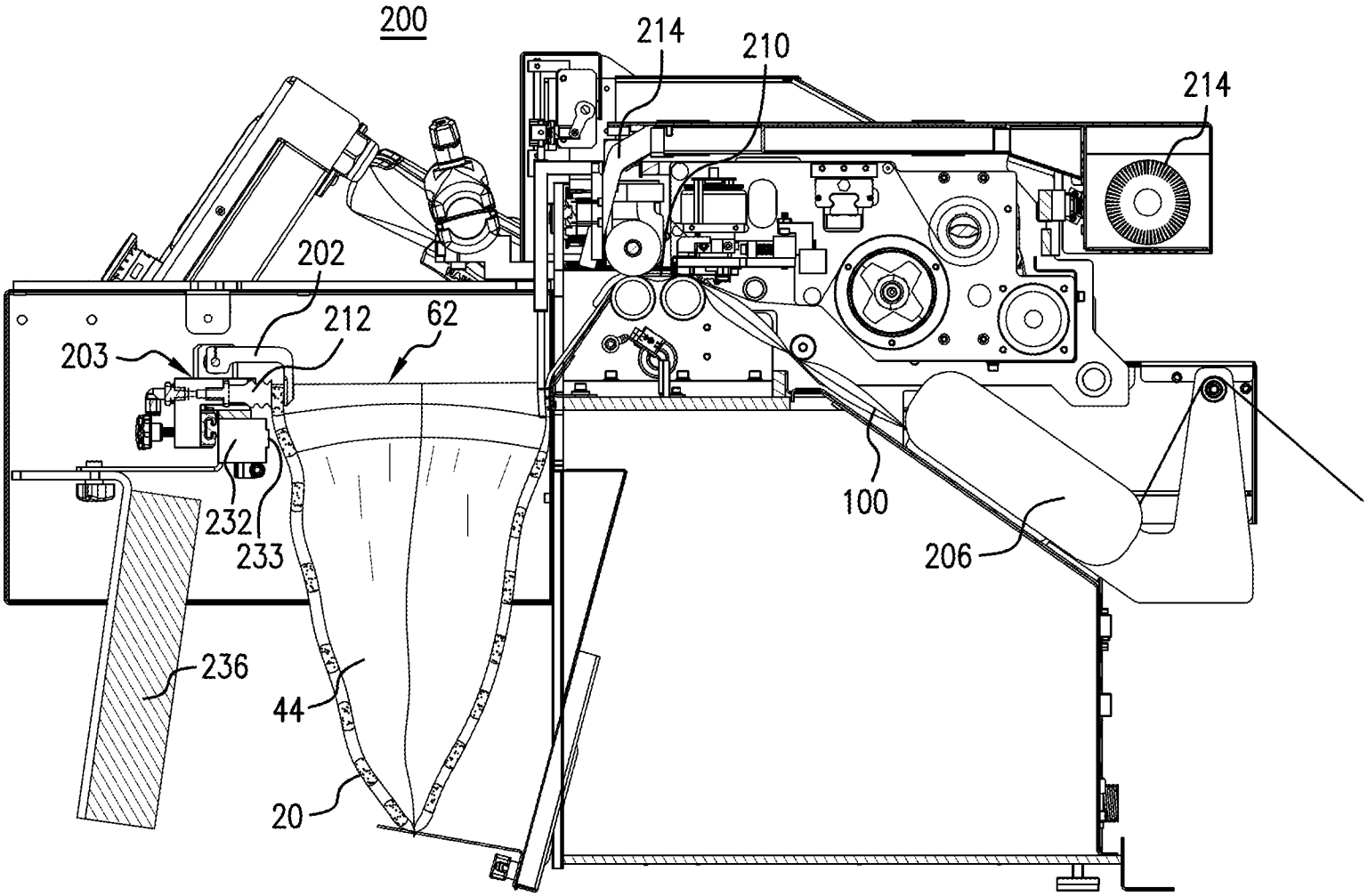
Figure 13:
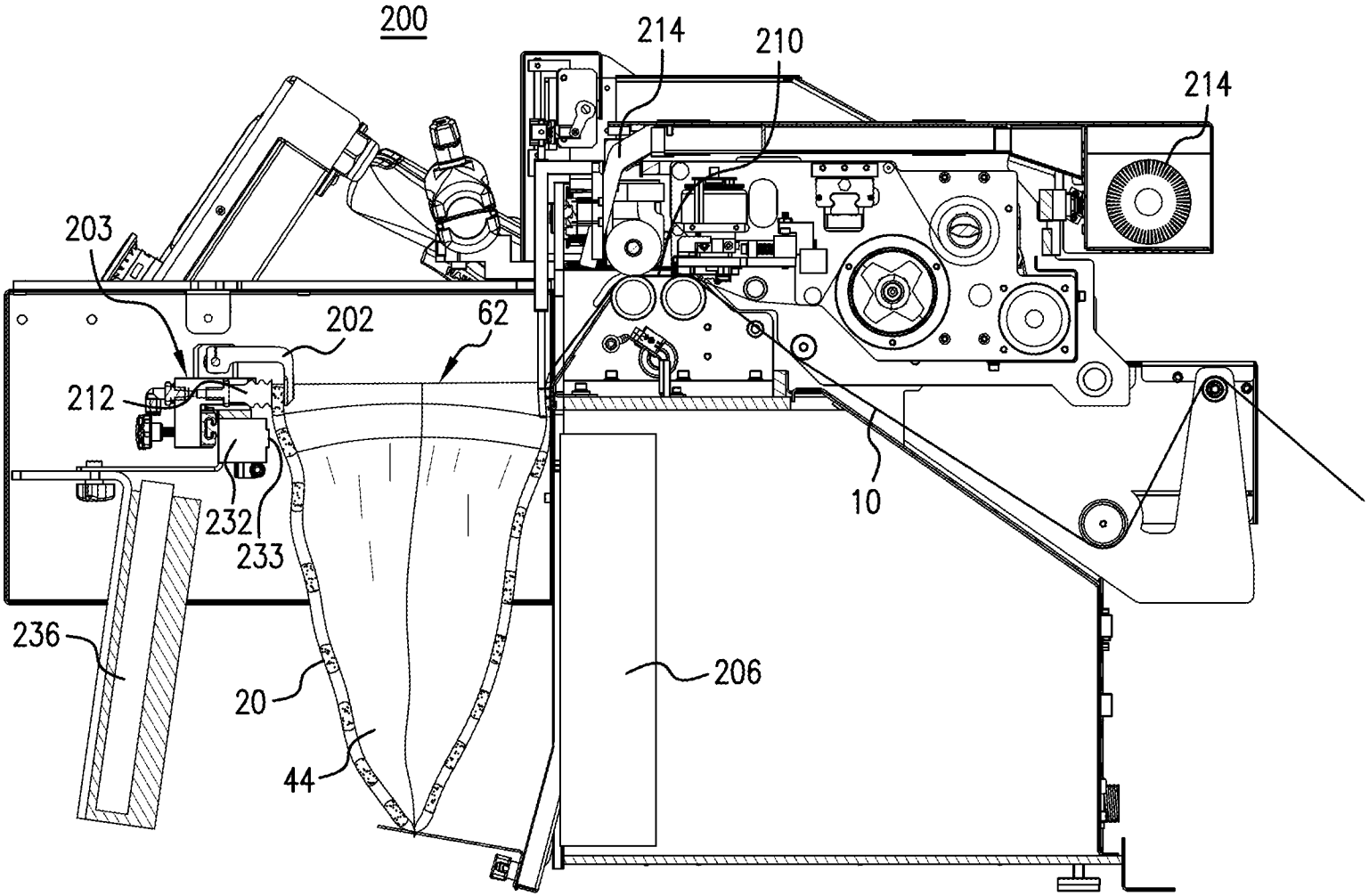
FIG. 13 is a cross-sectional side view of an expansion and bagging device in accordance with an embodiment.
Figure 15A:
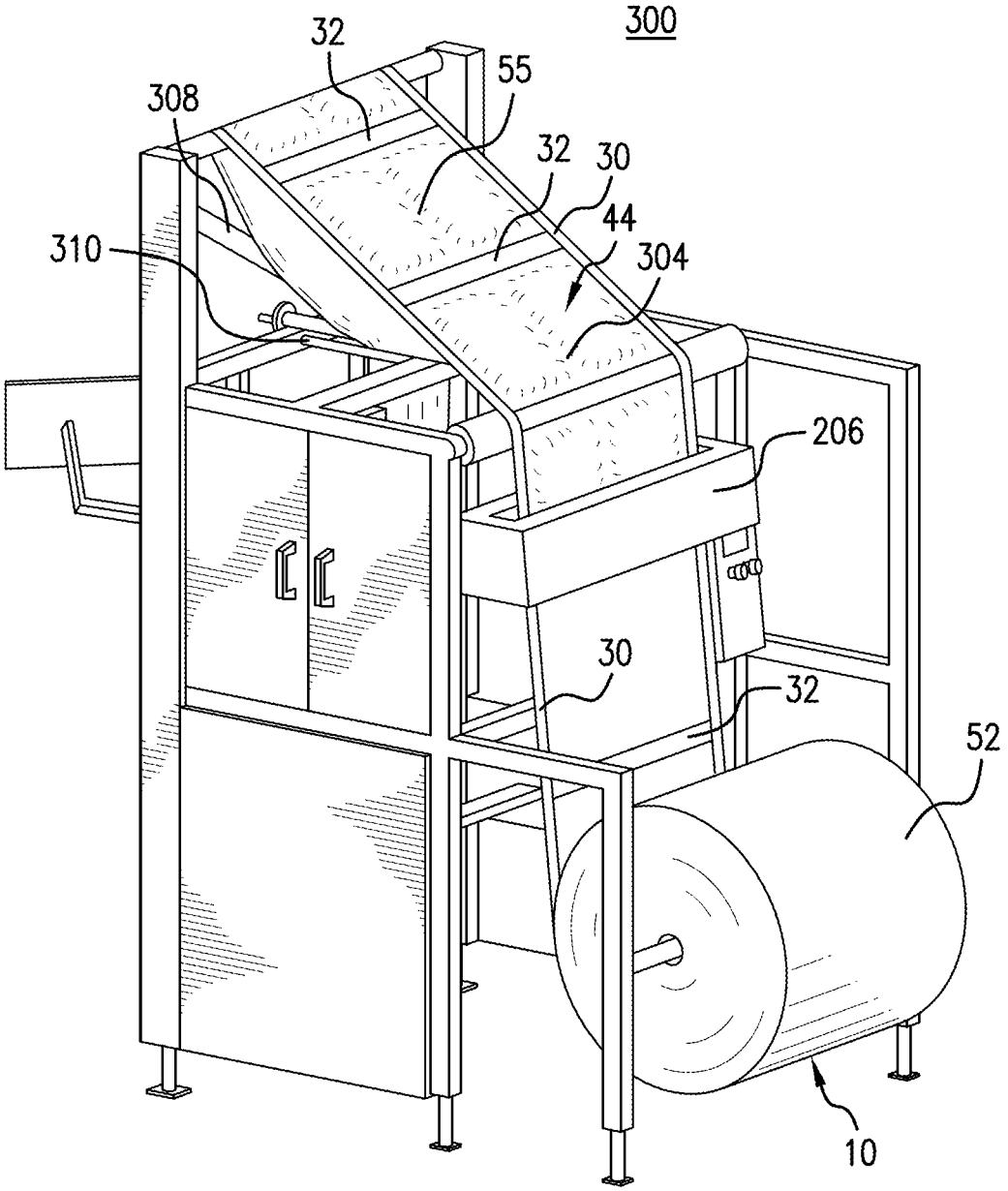
FIGS. 15A and 15B are rear and front perspective views of an expansion and bagging device according to an embodiment.
Figure 15B:
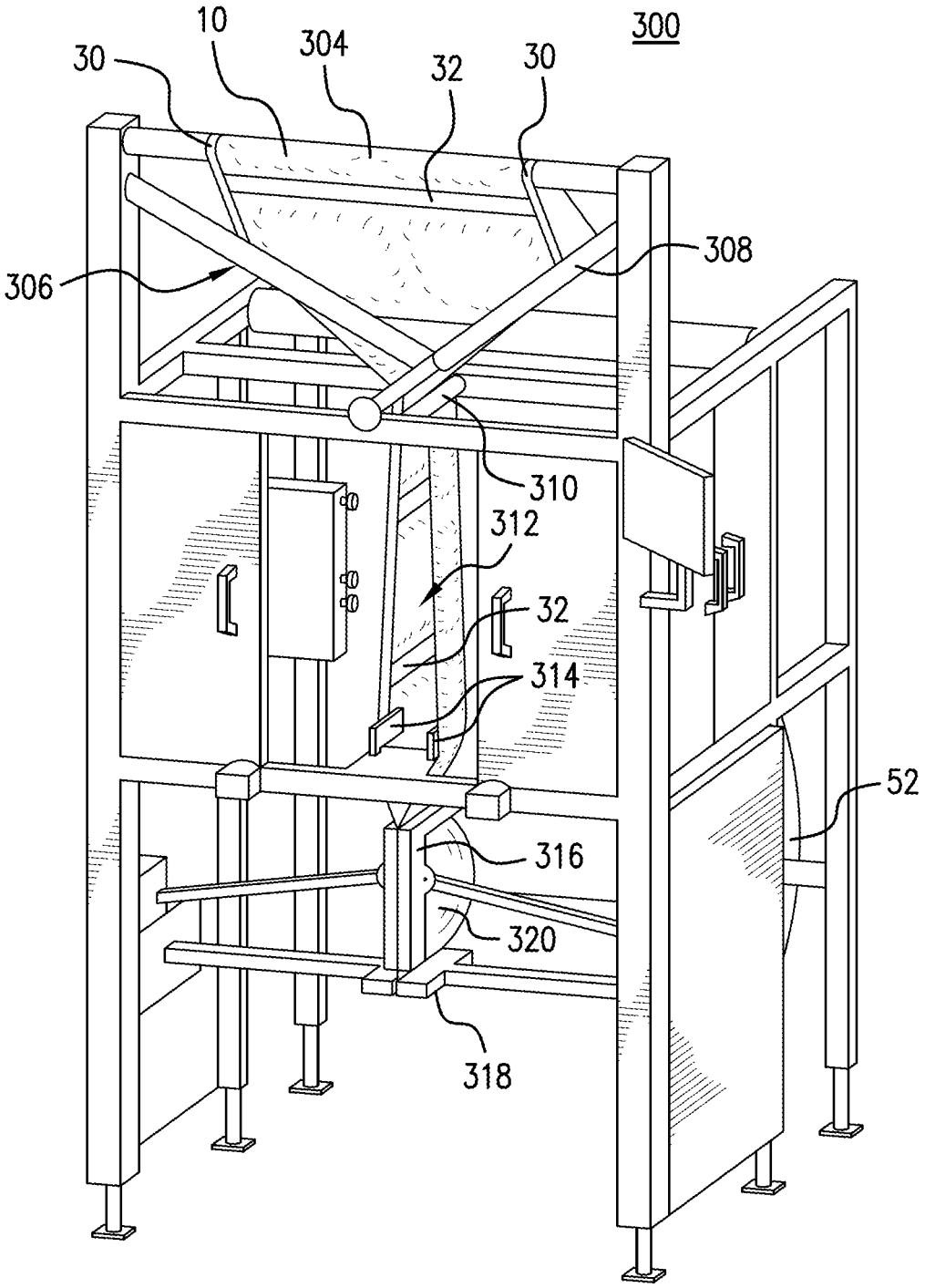

One or more steps in forming the series of bags are performed using protective packaging machines, such as the bagging machines 200 shown in FIGS. 12-13 and the bagging machines 300 shown in FIGS. 15A-15B.

As those shown in FIGS. 12-13, the bagging machine 200 is fed a web 10 that has been pre-folded and/or sealed in order to include a web 10 of preformed bag formations. In other embodiments, such as in FIGS. 15A-15B, the bagging machine 300 is configured to receive an unfolded or unsealed web 10 and form the web 10 into one or more packaging container formations 44.

If the web 10 includes expansion material 20, the bagging machine may, through application of heat or other suitable means, expand the expansion material prior to, during, or subsequent to setting the seals.

According to the embodiments shown in FIG. 12A-12B, the bagging machine 200 may be configured to receive a web 10 of preformed packaging container formations 44 and be configured to open the opening 62 in each bag formation in order to access the interior cavity 46 of each bag formation 44.

In the embodiment of FIG. 12A, the bagging machine 200 includes a plurality of fingers 202 and/or telescopic projections 204 configured to pull open the bag opening 62, enabling one or more products/objects/etc. to be inserted into the interior cavity 46.

The web 10 is fed into the bagging machine 200 in an unexpanded, high-density configuration. The web 10, at the supply side of the bagging machine 200, may be in a fanfold supply configuration 54 and/or other suitable configuration such as, for example a roll configuration 52.

The bagging machine 200 includes an expansion device 206. If the web 10 includes an expansion material 20, the expansion device 206 can include a heating element, heating coil, hot air applicator, radiofrequency radiation generator, UV light applicator, chemical reaction applicator, pressure mechanism, or other suitable device for expanding the expansion material. The fluid may be air or other suitable fluids. In some embodiments, the expandable element of the web 10 includes one-way valves to retain the fluid in the chamber. In some embodiments, such as that shown in FIGS. 12A-12B, the expansion mechanism 206 is positioned and configured to expand the expandable element prior to inserting a product into the interior cavity 46. In other embodiments, the expansion mechanism 206 is positioned and configured to expand the expandable element subsequent to inserting a product into the interior cavity 1105. In yet other embodiments, such as that shown in FIG. 13, the expansion mechanism 206 is positioned and configured to expand the expandable element during the inserting of a product into the interior cavity 46.

As shown in FIG. 12A, the expansion device 206 is positioned upstream from a bagging mechanism 208 to deliver the web 10 to the bagging mechanism 208. The bagging mechanism 208 is configured to seal and separate bag formations from subsequent bag formations, forming individual bags.

In other embodiments, the expansion device 206 is positioned at or downstream from the bagging mechanism 208 in order to cause the walls of the web 10 to expand at other points during the bag-making process. In some embodiments, such as that shown in FIGS. 12B and 13, a printing assembly 210 may be used to print one or more images and/or one or more pieces of data/information onto the web 10.

As shown in FIG. 12B, the expansion mechanism 206 is configured to expand the expansion element prior to opening the bag opening 62 for insertion of one or more products. In other embodiments, such as shown in FIG. 13, the expansion mechanism 206 is configured to expand the expansion element at the same time as or after opening the bag opening 62 for insertion of one or more products.

The web 10 includes one or more regions of weakness 50 and one or more openings 62, applied prior to the sealing process. In other embodiments, the one or more regions of weakness 50 and/or one or more openings 62 are applied during or after the sealing process. The regions of weakness 50 are configured to be broken in order to separate one packaging container from a subsequent packaging container. The openings 62 are configured and positioned to enable access to the interior cavity 46 of a packaging container formation 44 and may be opened by the mechanical fingers 202 and/or suction cups 212. Pressurized air can be used to aid in opening the opening 62 in the packaging container formations 44.

The fingers 202 are configured to pinch a portion of the packaging container opening 62, providing further securing means of opening up the packaging container at the opening 62 and holding the packaging container in place. The bagging machine 200 can include an air blower 214 configured to apply air pressure to the opening 62 to aid in opening the packaging container. The opening 62 can include a pouch seal. The pouch seal can include an adhesive for sealing closed the opening 62 once product is inserted. Other forms of sealing the opening 62, such as heat sealing, can, additionally or alternatively, be implemented. Once the opening 62 is closed and sealed, the regions of weakness 50 can be broken by suitable means such as, for example, reversing the next packaging container, cutting, melting, or other suitable means.

Each packaging container 44 in the web 10 can be separated using a pulling force applied to each packaging container 44, tearing the region of weakness 50 located between each bag in the series of bags, or using one or more cutting edges configured to form a laceration along the seam connecting two packaging containers 44 in the series of packaging containers 44. In some embodiments, each bag in the series of bags is separated using focused heat configured to melt a portion of the seam connecting two packaging containers 44 in the series of packaging containers 44.

Figure 14A:
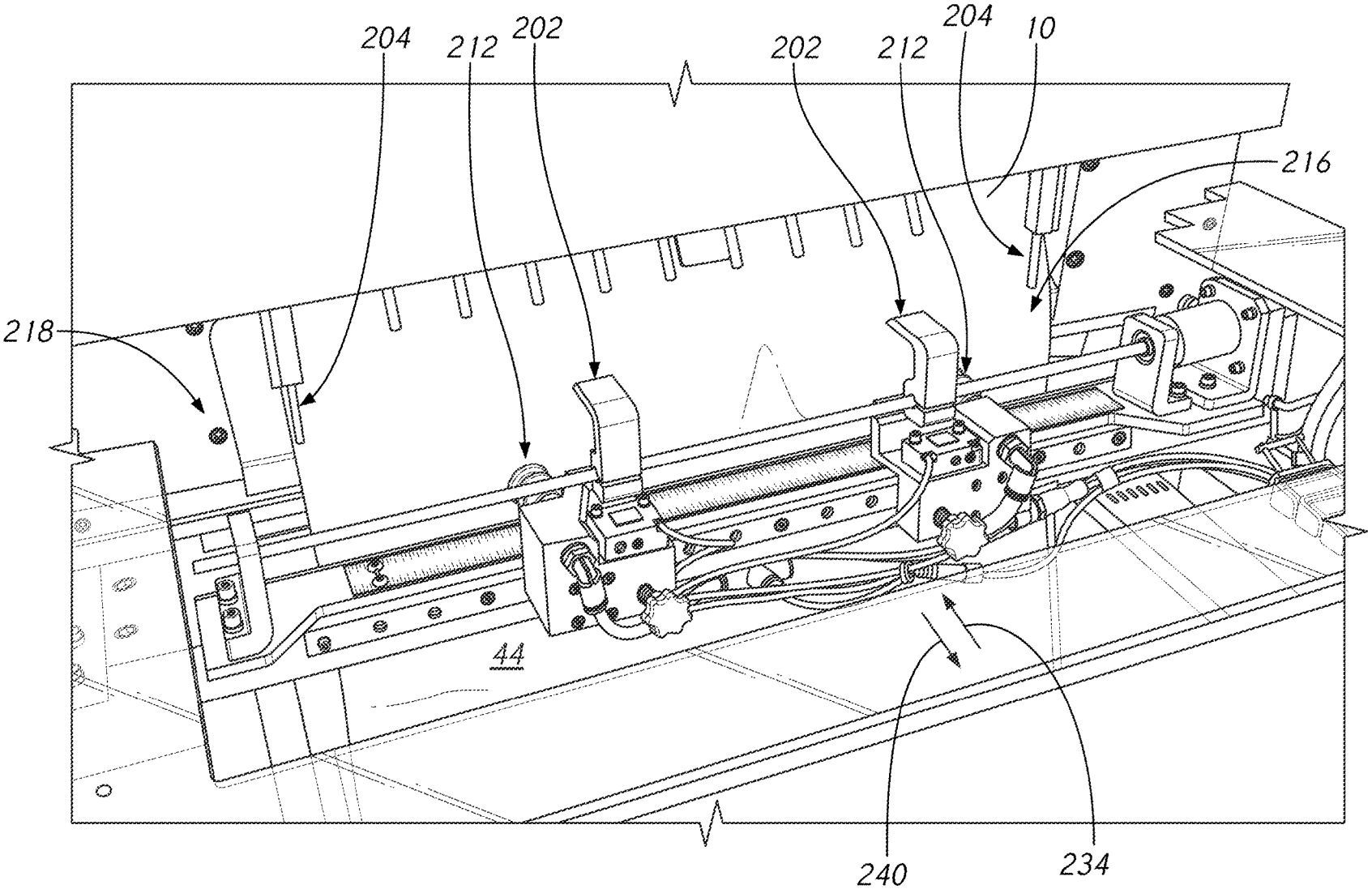
FIGS. 14A, 14B, 14C, 14D, 14E, 14F, 14G, 14H, and 14I are perspective views of a bag opening and sealing assembly of an expansion and bagging device in accordance with various examples of the present disclosure.
Figure 14B:
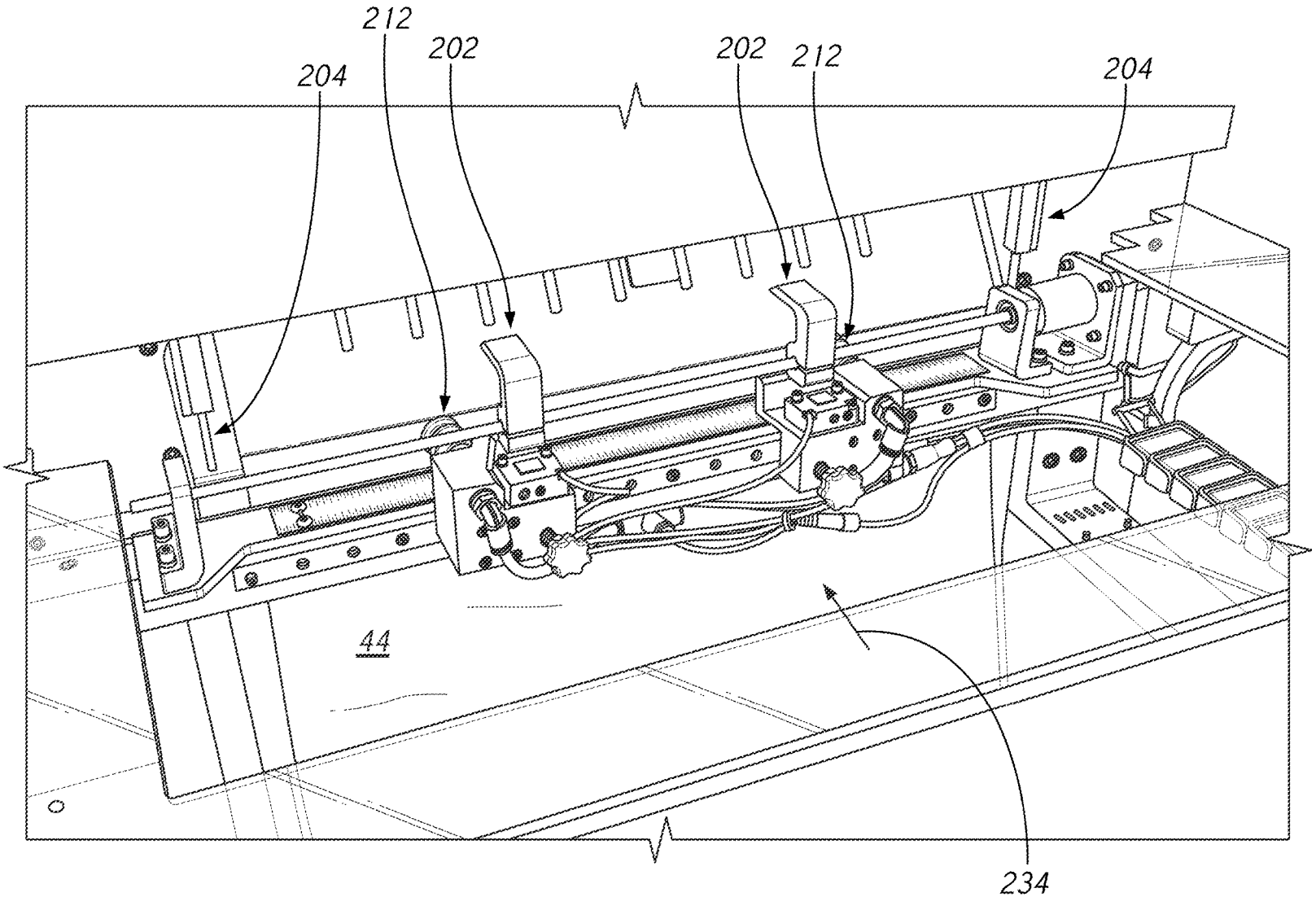
Figure 14C:
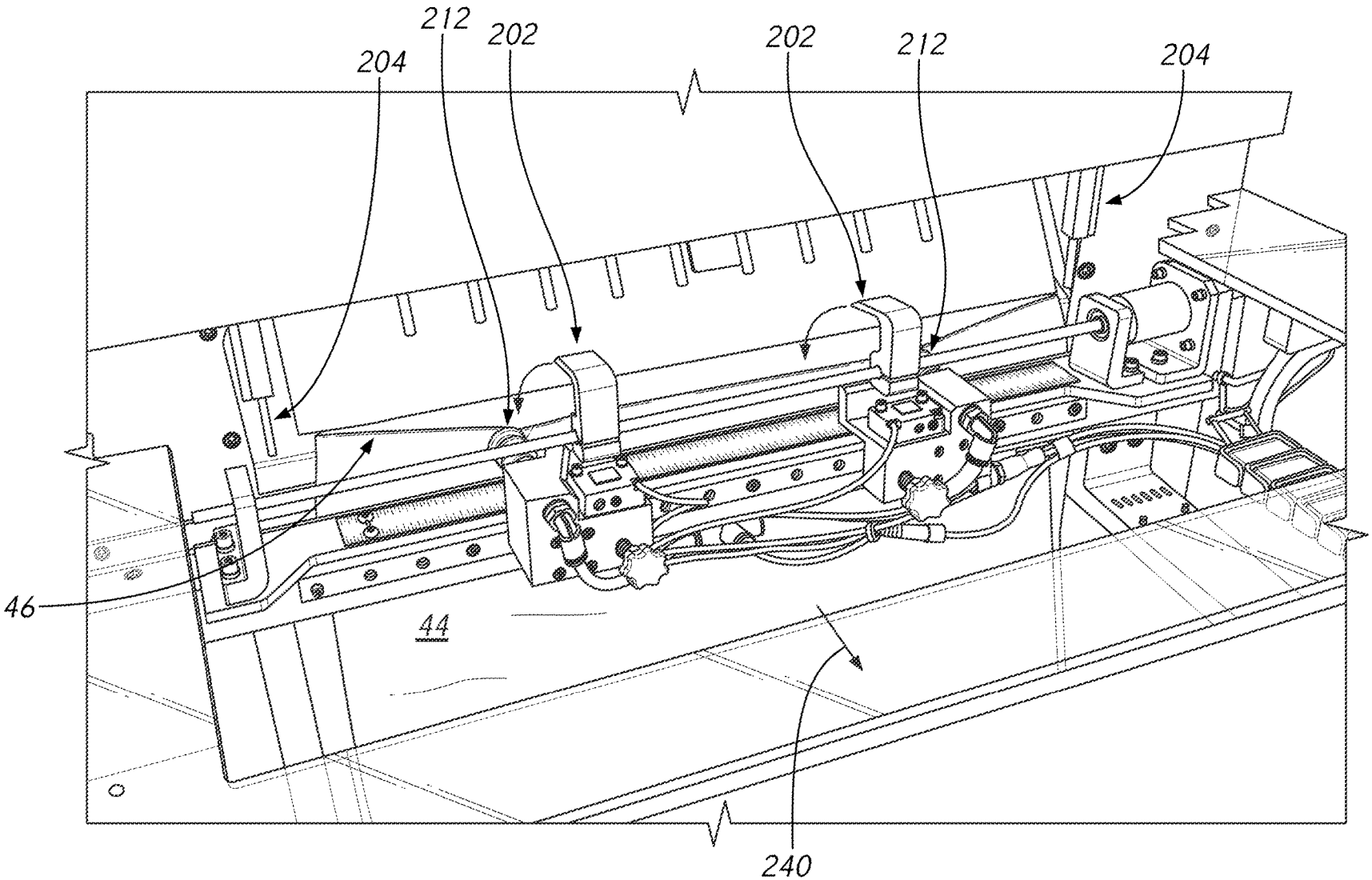
Figure 14D:
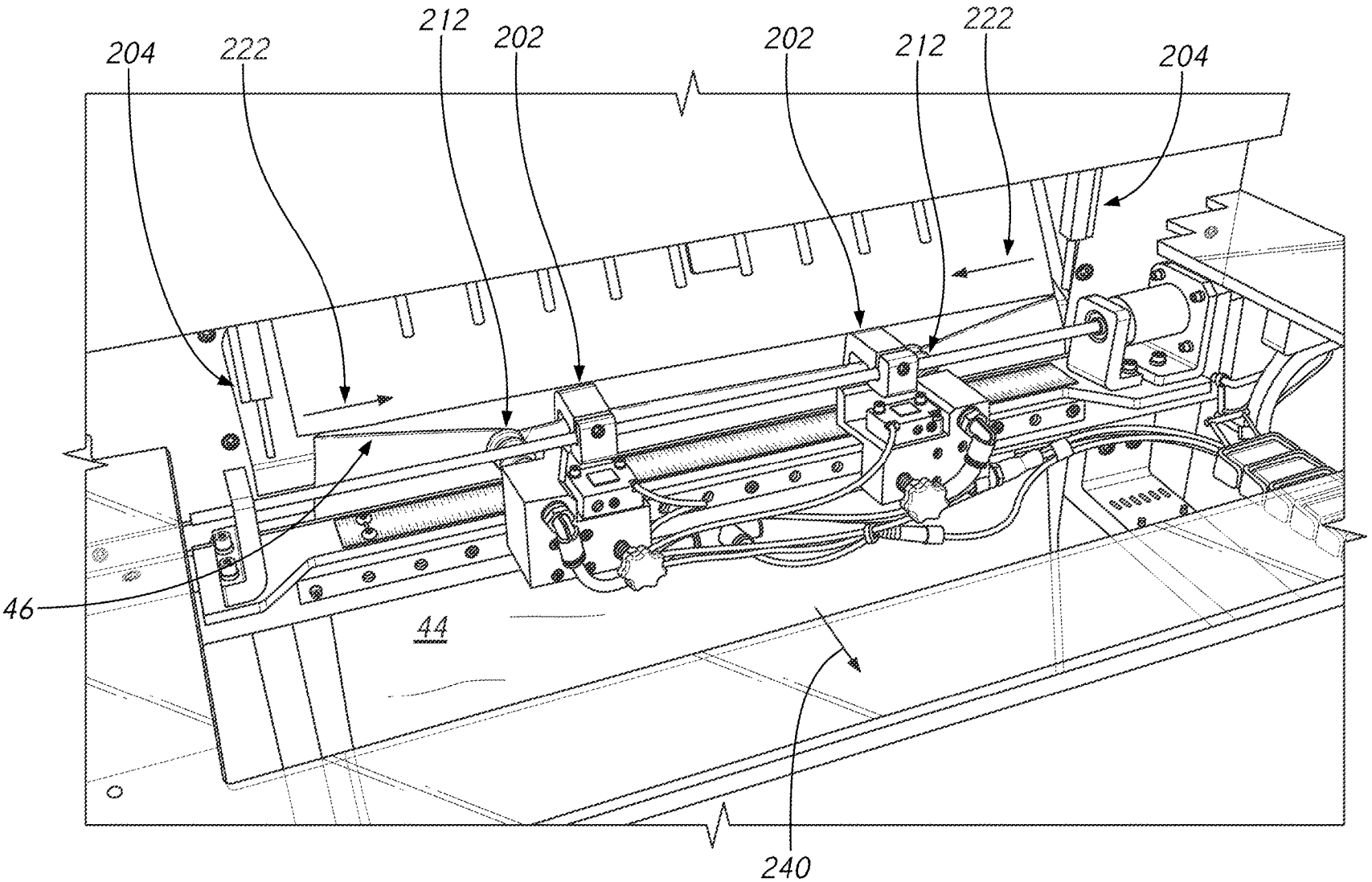

An operational sequence can begin with the web 10 advancing until the opening 62 is positioned above the sealing area 216, as shown in FIG. 14A, with the opening facing vertically and longitudinally along a length of the packaging unit. The amount of web 10 advancement to properly position the opening 62 may be programmed into the controller sequence based on the bag length (that is, the system may, each time, advance the same amount of web 10) or alternatively computer vision (e.g., an optical sensor) may be used at the inlet 218 to pause the advancement of the web 10 when the presence of the region of weakness 50 is at an appropriate location of the bag inlet 218. The bagging machine 200 can include a control panel 220 (as shown in FIG. 12A) configured to control one or more of the functions of the bagging machine 200. As shown in FIG. 14B, the sequence continues with the initial opening of the packaging container 44. The bagging machine 200 may utilize a vacuum assist device (e.g., suction cups 212) (and/or an air knife or other suitable device) to slightly enlarge the opening 62 to allow for the insertion of the fingers (e.g., rear fingers 204 and front moveable fingers 202) into the opening 62. In this and previous stages, the rear film-control elements (e.g., fingers 204) may be in a disengaged position relative to the web 10 (e.g., in this example, positioned outward of a perimeter of the web 10). As shown in FIG. 14C, after the initial opening 62 is provided, the front film-control elements are deployed (e.g., fingers 202 are rotated down into the opening 62 to grip the front side of the packaging container 44). At this time, the rear film-control elements (fingers 204) are also deployed and, as shown in FIG. 14D, the rear fingers 204 are moved towards the centerline of the inlet 218, as shown by arrows 222. In some embodiments, the rear fingers 204 are translated inward to positions in which the rear fingers 204 substantially align with the front fingers (or telescopic projections) 202, at which point they may be transversely extended into the opening 62. In other embodiments, the fingers 204 can be advanced to different transverse positions (e.g., to a position in which they are closer together than the front fingers 202) before they are extended into the packaging container 44. In the case of telescoping fingers 204, for example, air pressure may be used to deploy the telescoping portion into the packaging container 44 (e.g., via a release of pressurized air against the telescoping portions 224 of the fingers 204).

Figure 14E:
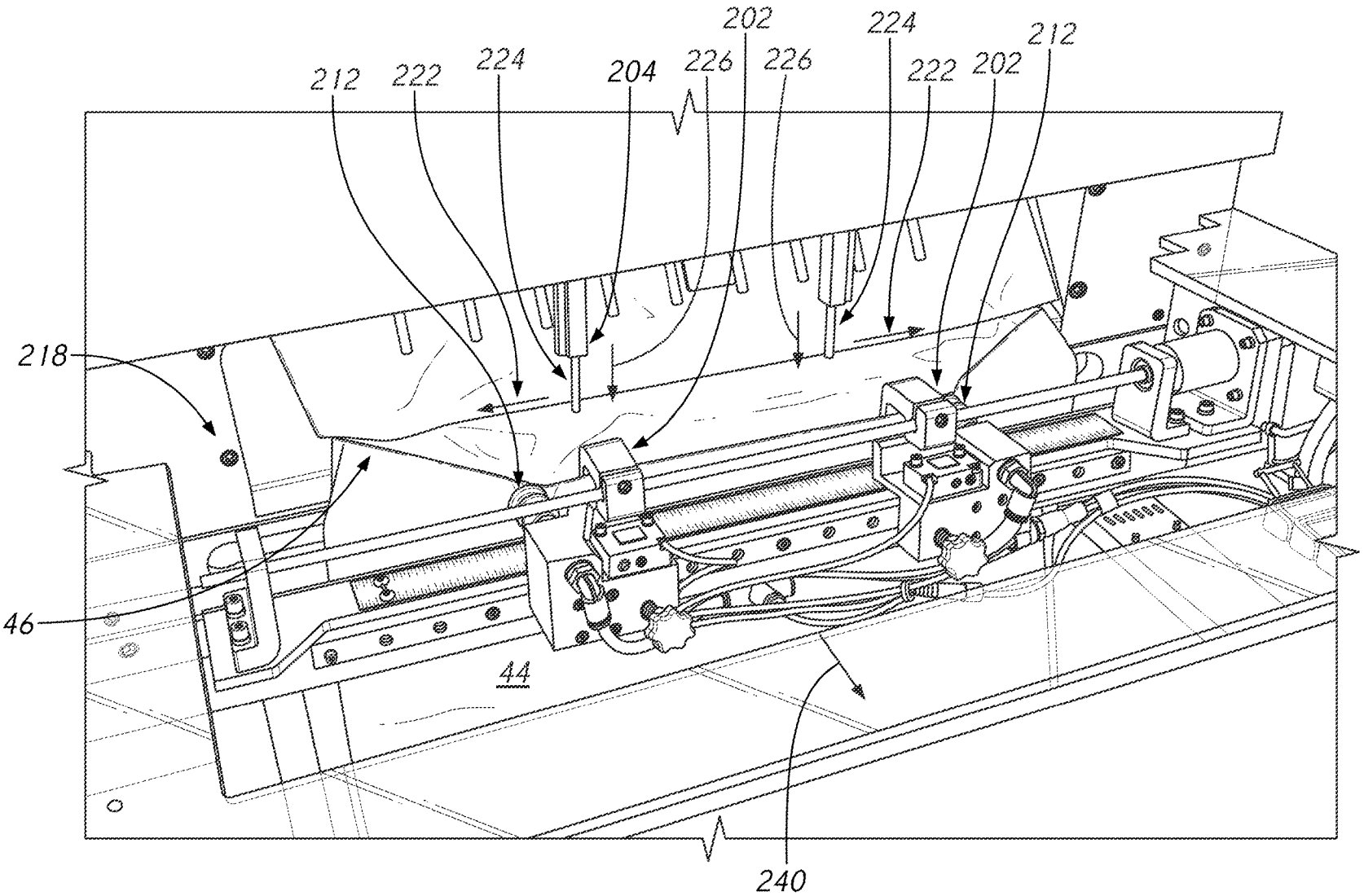
Figure 14F:
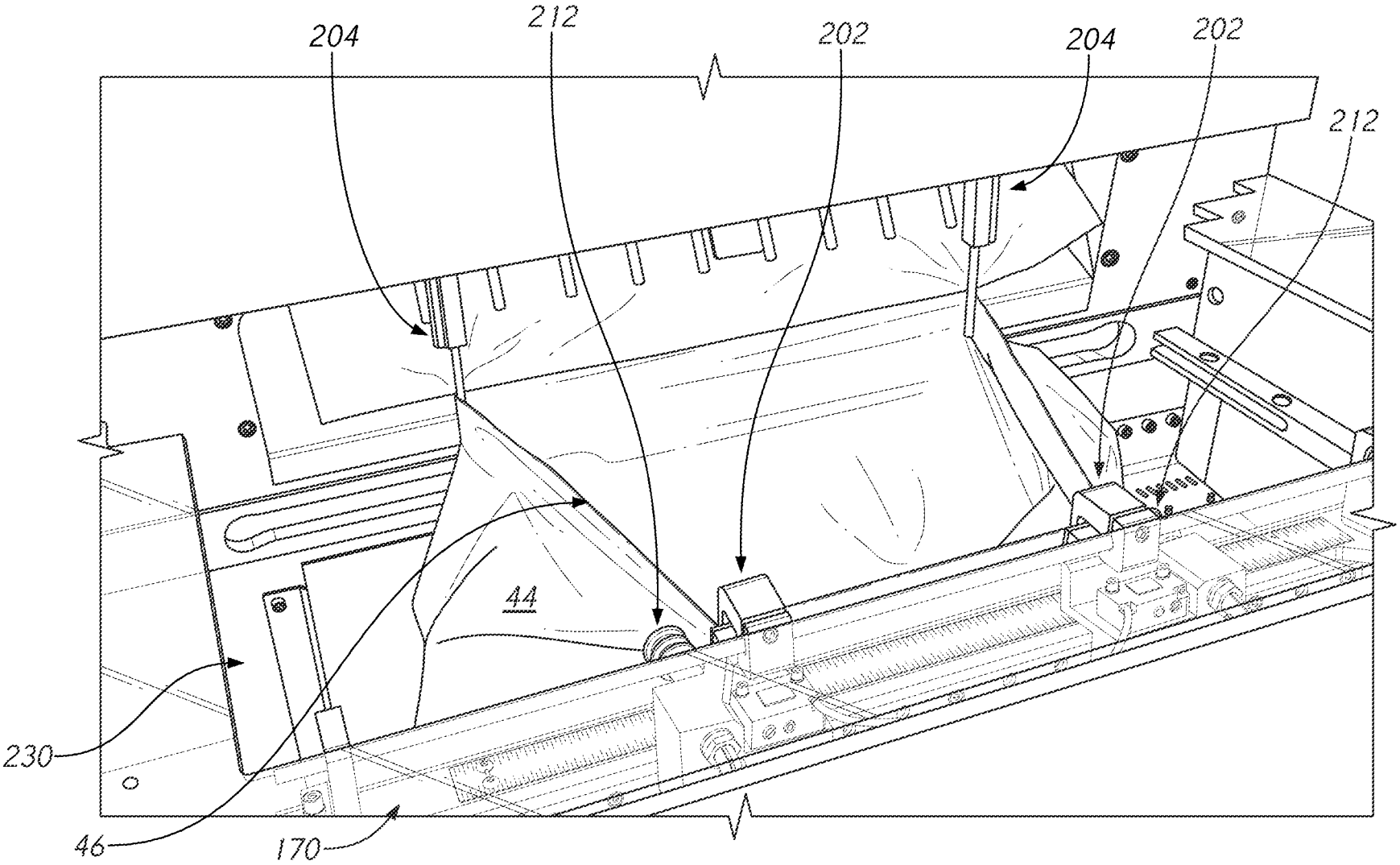

As shown in FIG. 14E, the extension of the fingers 204 into the opening 62 (along direction 226) may be performed concurrently with (or shortly before) the spreading outward of the fingers 204 (along direction 226) and also while the front fingers 202 are advanced away from the bag inlet 218 (along the opening direction 240), which causes the opening 62 to become tautly engaged between the rear and front fingers 204, 202, as shown in FIG. 14F. The front fingers 202 may be mounted on a moveable structure 203 (as shown in FIGS. 12A-12B and 13) configured to enable movement of the front fingers 202. In some embodiments, the suction cups 212 are mounted to the moveable structure 203.

As shown in FIG. 14F, leading up to this point, a portion of the rear perforation, near the longitudinal edges of the web 10 may tear or have torn. However, a least a portion (e.g., up to 50% and typically more than 50%) of the rear perforations remain intact to keep the packaging container 44 attached to the web 10 until product loading is complete. At this point, the packaging container 44 is ready for product to be loaded into it the interior cavity 46, which may be performed by a human operator or a robot operator controlled by the bagging machine 200. In the case of a human operator, the control system 220 may display instructions to the user (e.g., for loading the packaging container 44) and/or may await operator input, which may be provided by the user placing his or her hands on the hand stations or contacts associated with a safety shroud 228 to indicate that the product has been provided in the packaging container 44 and that the operator's hands are free from the bagging area 230. In the case of a robot operator, a signal indicated the completion of the product loading sequence may be generated in the background and transmitted to the controller to automatically initiate the bag closing and sealing stages of the process.

Figure 14G:
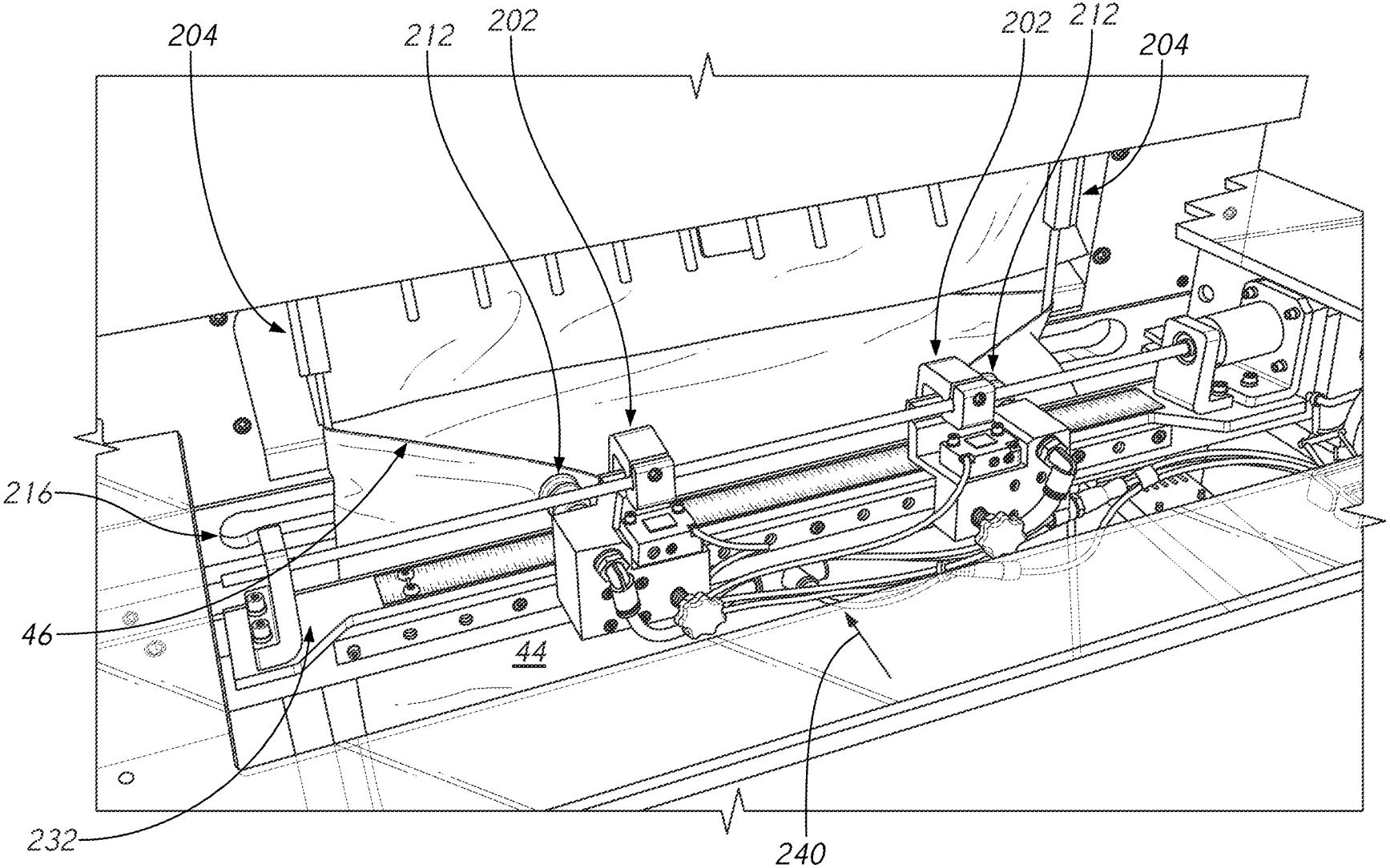

As shown in FIG. 14G, during bag closing, a pressure plate 232 is advanced in the bag closing direction 234 while the front fingers 202 remain in the closed position gripping the front side of the opening 62. The bagging machine 200 can further include a pad 236 (as shown in FIG. 14A) (e.g., a foam pad) configured to apply pressure to the bag to remove air from the packaging container 44. Concurrently, the rear fingers 204 are translated outward (in the direction 222) to widen the bag opening 62 and thus flatten out the top portion of the packaging container 44, preparing it for the sealing operation. During the sealing operation, the pressure plate 232 is pressed against the sealing area 216 allowing the bumper on the pressure plate 232 to resiliently deform thereby applying a suitable amount of pressure against the front and rear sides of the bag to effect the sealing operation.

Figure 14H:
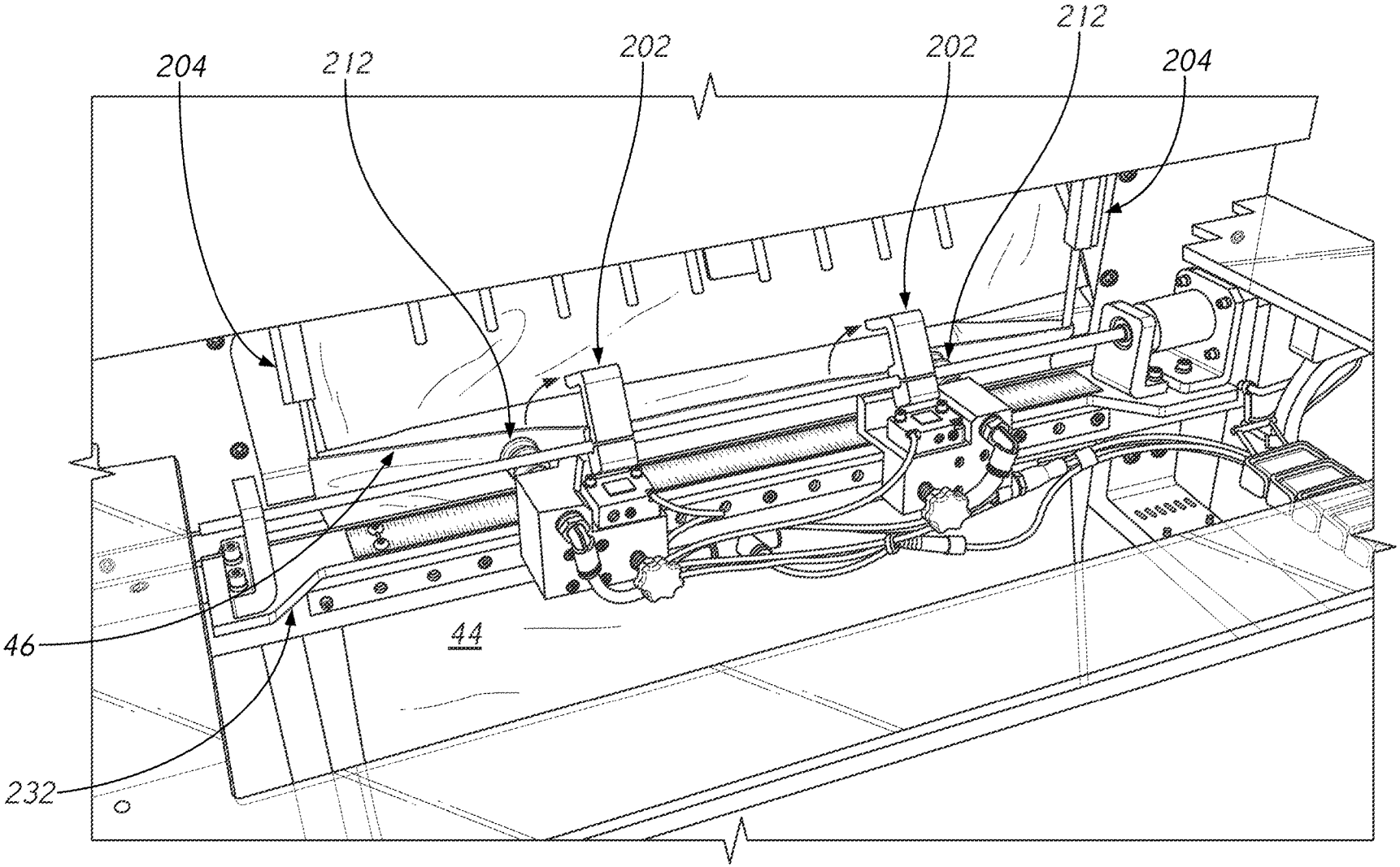
Figure 14I:
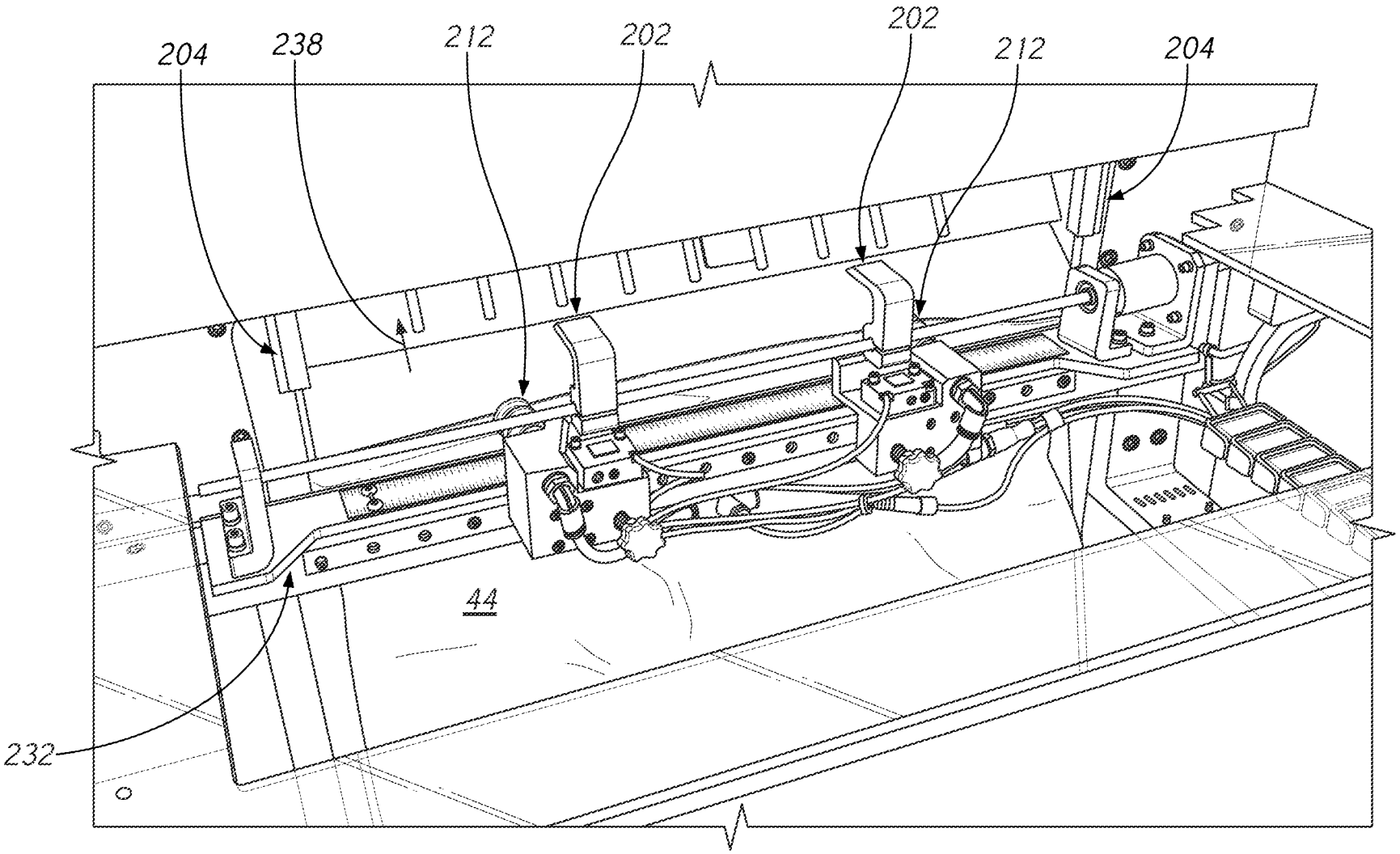

As shown in FIG. 14H, as the pressure plate 232 engages the sealing area 216 and/or the sealing operation is complete, the front fingers 202 are disengaged from the opening 62 (e.g., pivoted to the open position), while the rear fingers 204 remain in engagement with the outer edges of the opening 62. This maintains the opening 62 flat during the completion of the sealing operation. In some embodiments, the pressure plate 232 includes a sealing mechanism 233 such as, for example, a heating element (such as shown in FIGS. 12B and 13). Upon completion of the sealing operation, the rear region of weakness 50 is torn, for example by reversing the web 10 (along direction 238) as shown in FIG. 14I, thereby separating the filled and sealed packaging container 44 and releasing the sealed packaging container 44 towards the bag outlet.

As shown in FIGS. 15A-15B, a bagging machine 300 is configured to both convert and seal the web 10 into one or more completed packaging containers 302. The web 10 is fed into the bagging machine 300 in an unexpanded, high-density configuration. The web 10 can be in a roll configuration 52. In other embodiments, the web 10 can be in one or more other unexpanded, high-density configurations such as, for example, a fanfold configuration.

Once fed into the bagging machine 300, the web 10 passes through an expansion device 206 configured to expand the expandable element of the web 10. According to some embodiments, the web 10 includes one or more hinge lines 55 which include a section 304 of the web 10 that is unexpanded, or includes less of, or is absent, an expansion material, forming a natural hinge to facilitate folding of the web 10. In some embodiments, lines of the web 10 can be left free of expansion material 20 to form natural hinge lines or regions that are more easily bent than other regions in which the expansion material 20 is expanded. In some embodiments, pressure is applied to the expansion material 20 during or subsequent to expansion, forming hinge lines or regions 55 at section 304 that are more easily bent than other regions.

The expanded web 10 proceeds to be fed through a folding apparatus 306 configured to fold the web 10 such that the longitudinal edges of the web 10 come into contact with each other. The folding apparatus 306 may include one or more folding bars 308 configured to fold the web 10 into a C-fold formation. The folding apparatus 306 can fold the web 10 along hinge area 55, or at one or more other sections. The folding apparatus 306 may further include a cross-bar 310 configured to align the web 10 such that the folded web 10 forms an interior cavity 312. Once folded, a series of retaining mechanisms (e.g., fingers 314) hold open the web 10, enabling one or more products to be placed into the interior cavity 312. In FIG. 15B, the web is positioned vertically while the product is placed into the interior cavity 312 horizontally, while the opening is transverse to a longitudinal direction of the web. In other embodiments, the web can be positioned horizontally or at another suitable angle (e.g., with the opening to the interior cavity 312 facing upwards).

Once the product is placed into the interior cavity 312, the web 10 is fed to a sealing mechanism 316 configured to seal the longitudinal seal and transverse seals of the web 10. The sealing mechanism 316 can be configured to apply heat, pressure, and/or other suitable means of setting the seals. In some embodiments, the sealing mechanism 316 is configured to pull the web through the bagging machine 300 for sealing. Once sealed, the web 10 is converted into a formed and sealed bag 302. According to some embodiments, the bagging machine 300 includes a separating mechanism 318 configured to separate a bag 44 from the web 10. In some embodiments, the separating mechanism 318 is configured to pull on the completed bag 320, tearing the completed bag 320 from a subsequent bag along a region of weakness 50. In some embodiments, the separating mechanism 318 is configured to separate the bag 320 via cutting via a blade or heat. In some embodiments, the separating mechanism 318 may incorporate other suitable means of separation. According to some embodiments, the separating mechanism 318 is configured to hold the bag 302 in place to enable the sealing mechanism 316 to seal a subsequent bag.

Figure 16:
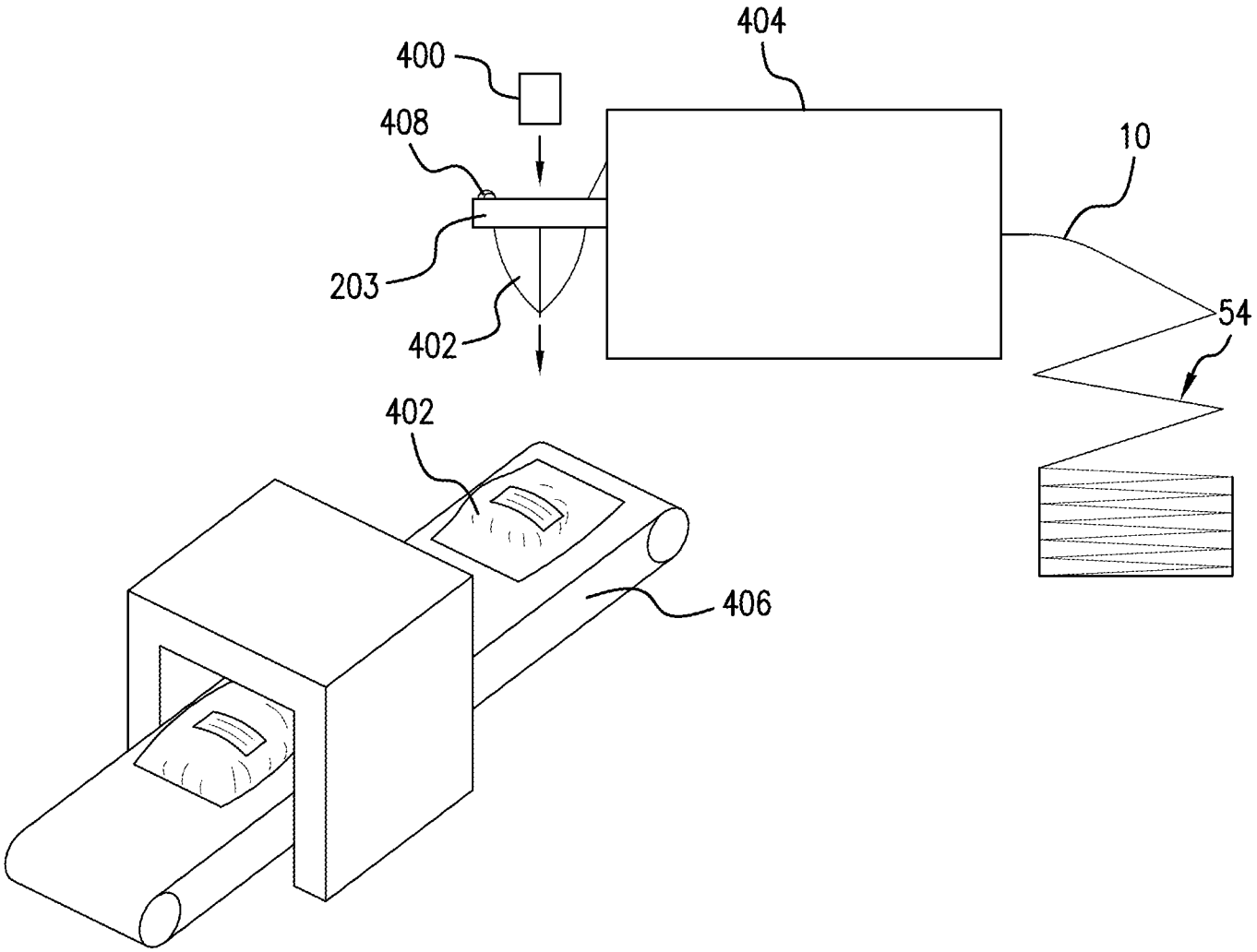
FIG. 16 is a perspective cutaway view of an expansion device of an expansion and bagging device.

As shown in FIG. 16, an opening to a packaging container 402 is expanded using an expander 408, enabling a product 400 to be inserted into the packaging container 402. Once the product 400 is inserted into the packaging container 402, the packaging container 402 is sealed and leaves the bagging mechanism 404 and is transported, via a transport mechanism 406, for shipment. The bagging mechanism 404 can be a bagging mechanism as described herein such as, for example, bagging mechanism 200.

Figure 17:
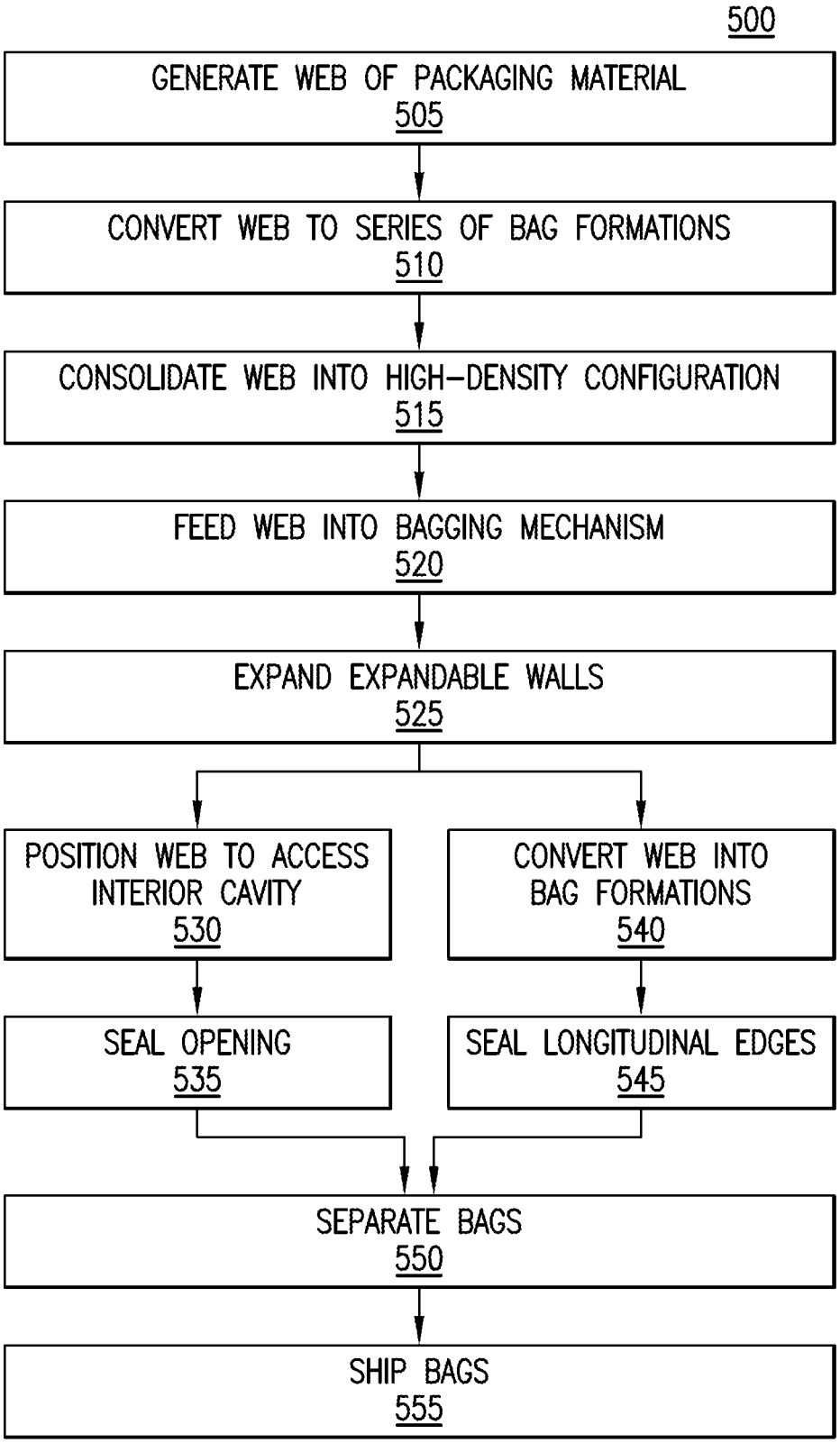
FIG. 17 is a flowchart of a method for generating one or more packaging elements, in accordance with various embodiments.

According to the method 500 of FIG. 17, at 505, a web of packaging material is generated. The web can include one or more plies. The web can include one or more of a first ply, a second ply, and an expandable element coupled to the first ply and/or the second ply. One or more of the plies can include paper (e.g., cardboard, kraft paper, fiberboard, pulp-based paper, recycled paper, newsprint, and coated paper such as paper coated with wax, plastic, water-resistant materials, and/or stain-resistant materials), plastic, cellulose, foil, poly or synthetic material, biodegradable materials, and/or other suitable materials of suitable thicknesses, weight, and dimensions. The plies can include recyclable material (e.g., recyclable paper). The expandable element can be positioned between the first ply and the second ply. When applied, the expandable element is in an unexpanded configuration. Referring to the flow chart, the method 500 is described using suitable devices and systems described herein. Suitable devices and systems include, for example, but not limited to, system 70 of FIGS. 9A-9B, bagging machine 200 of FIGS. 12A-12B and 13, bagging machine 300 of FIGS. 15A-15B.

The expandable element can include one or more expansion materials in an unexpanded configuration. The one or more expansion materials can include an emulsion-based polymer that includes starch, vinyl acetate ethylene, polyvinyl acetate, polyvinyl alcohol, one or more polyvinyl acetate copolymers, one or more polyvinyl alcohol copolymers, dextrin stabilized polyvinyl acetate, one or more polyvinyl acetate copolymers, one or more vinyl acetate copolymers, one or more ethylene copolymers, vinylacrylic, styrene acrylic, acrylic, styrene butyl rubber, polyurethane, biodegradable materials (e.g., cellulose), and/or other suitable expansion materials.

In some embodiments, the expansion material can include a polyolefin based adhesive or a polyolefin dispersion. The polyolefin dispersion can include polyethylene and/or polypropylene, and/or other suitable polyolefin dispersions. A suitable polyolefin dispersion can include, for example HYPOD™, from Dow Chemical, or other suitable polyolefin dispersions. The expansion material can be applied to the web as a continuous layer or in a pattern. The pattern can be configured such that, when the plies are pressed together, the expansion material spreads out, forming a continuous layer.

In some embodiments, the expansion material can include an adhesive and thermally expandable microspheres combined with the adhesive to generate a thermally expandable adhesive. The microspheres can be mixed with the adhesive prior to application on the web, or layered on top of the adhesive after it has been applied to the web enabling the microspheres to be forced into the adhesive when the plies are pressed together. For example, the expansion material can include an adhesive applied to a first ply with microspheres applied loosely to a surface of the adhesive. Microspheres that do not stick to the adhesive can then be collected and discarded or reused, and the microspheres that stick to the adhesive are pressed into the adhesive when a second ply is applied over the first ply, sandwiching the adhesive and the microspheres between the first ply and the second ply.

Generating the web can include forming one or more regions of weakness along the web. The one or more regions of weakness can be positioned along the first ply and/or the second ply and configured to enable separation of one packaging element from another packaging element. The one or more regions of weakness can include one or more scores, slits, perforations, ticks on one or more longitudinal edges of the web, one or more combination of the aforementioned, and/or other suitable forms to regions of weakness.

At 510, the web, prior to being consolidated, is converted into a series of bag formations. The converting can include applying one or more seals to an outer surface of the web and folding and sealing the web, forming the bag formation. The bag formation includes an interior cavity configured to receive one or more goods, products, etc. The converting can include forming an opening configured to enable access to the interior cavity. According to some embodiments, the expandable element is positioned against the opening. According to other embodiments, the expandable element is spaced from the opening. According to some embodiments, the web is not formed into a bag formation prior to consolidation.

Once the web is formed, the web, at 515, is consolidated in an unexpanded, high-density configuration, forming a web stock of packaging material. The unexpanded, high-density configuration may be a rolled configuration, a fan-fold configuration, and/or other suitable high-density configurations. It is noted that, in some embodiments, the one or more regions of weakness may be formed subsequent to consolidating the web into the unexpanded, high-density configuration.

Subsequent to being consolidated into the unexpanded, high-density configuration, at 520, the web is fed into a bagging mechanism.

At 525, the one or more expandable walls are expanded by causing the expandable element to expand. The expansion is performed using one or more expansion devices of the bagging mechanism. The expansion occurs subsequent to the web being consolidated into the unexpanded, high-density configuration.

The expandable element can include one or more expansion materials, expanding the one or more expandable walls includes applying a catalyst to convert the one or more expansion materials from a high-density configuration to a low-density configuration. The catalyst can be heat, a chemical catalyst, a physical catalyst, and/or other suitable catalysts.

If the web is pre-formed into a series of bag formations, the bagging mechanism, at 530, positions the web to access the interior cavity of each of the bag formations to allow loading of one or more products into the interior cavity. Positioning the web can include opening the bag formation at the opening using one or more of the techniques described herein and/or other suitable means. The web can include a strip of sealable material positioned along the opening. The strip of sealable material is configured to seal off the opening subsequent to the loading of the one or more products into the interior cavity. At 540, the opening is sealed off using the strip of sealable material. The strip of sealable material can be any suitable sealable material described herein such as, for example, heat sealable material, pressure sealable material, adhesive material, cohesive material, and/or other suitable sealable materials.

If the web is not pre-formed into a series of bag formations, the bagging mechanism is configured, at 540, to convert the web into one or more bag formations using the techniques described herein and/or other suitable means. The converting can include folding the web such that longitudinal edges of the web meet, and, at 545, one or more seals are formed, sealing the longitudinal edges together. The converting can further include forming one or more seals transverse to the one or more longitudinal seals.

At 550, subsequent to or concurrently with sealing the opening or sealing the longitudinal edges together, the bagging mechanism separates one bag from a subsequent bag formation in the web and, at 555, the package is sent for shipment.

The methods and apparatuses described herein may provide packaging elements with one or more pressure adhesive seals. The use of pressure adhesive seals may reduce or eliminate the number of heat seals used to form the mailers.

Examples of bagging machines such as bagging maching 200 of FIGS. 12A-12B and 13, can further function in accordance with U.S. Patent Publication No. 2020/0115082, filed Oct. 11, 2019 and incorporated herein by reference. Examples of suitable systems and methods for providing expandable material such as, for example, that shown in FIGS. 1, 3-4, 6-7, 9A-9B, and 10, are disclosed in U.S. Provisional Patent Application No. 62/706,111, filed Jul. 31, 2020, titled "METHOD OF MAKING AN EXPANDABLE WEB", the content of which is herein incorporated by reference in its entirety. Examples of expandable materials and compositions of expansion materials can be found in U.S. Patent Publication No. 2019/0062028, filed Sep. 11, 2018.

The present disclosure is not to be limited in terms of the particular examples described in this application, which are intended as illustrations of various aspects. Many modifications and examples can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is also to be understood that the terminology used herein is for describing particular examples only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A packaging material web stock, comprising:

a plurality of adjoined packaging units arranged longitudinally in a series, each of the packaging units comprising:

a plurality of walls overlaid with each other to define an inter-wall cavity therebetween that is configured to house an object to be shipped, and a plurality of inter-wall seals configured to seal the walls to each other and including a plurality of transverse inter-wall seals that extend transversely across the walls of a respective one of the packing units and are located at a first and a second longitudinal end of the respective packaging unit, wherein each of the walls comprises:

first and second plies overlaid and sealed to each other at a plurality of inter-ply seals that include a plurality of transverse inter-ply seals extending transversely across the plies, wherein an inter-ply cavity is defined between the overlayed plies and the transverse inter-wall seals of the respective packaging units; and an expansion material disposed in the inter-ply cavities in an unexpanded configuration, the expansion material having a composition to expand into an expanded configuration upon application of expanding conditions, wherein the expansion material is arranged within the interior inter-ply cavities such that when expanded to the expanded configuration the expansion material is configured to provide cushioning in the walls to the object to be shipped.

2. The packaging material web stock of claim 1, wherein the web is consolidated in a high-density configuration.

3. The packaging material web stock of claim 2, wherein, in the high-density configuration, the web is rolled into a roll.

4. The packaging material web stock of claim 2, wherein, in the high-density configuration, the web is folded into a fanfold stack.

5. The packaging material web stock of claim 1, wherein each of the packaging units includes at least one of the inter-wall cavities.

6. The packaging material web stock of claim 1, wherein the packaging units are arranged in a repeating series.

7. The packaging material web stock of claim 1, wherein all of the packaging units are the same.

8. The packaging material web stock of claim 1, wherein the packaging units are pads that each include a single one of the walls.

9. The packaging material web stock of claim 1, wherein the walls are unsealed on a side of the interior inter-wall cavity to provide an opening into the interior inter-wall cavity configured for receiving the object into the interior inter-wall cavity.

10. The packaging material web stock of claim 9, further comprising an opening sealing material disposed on at least one of the walls for sealing the walls together at the opening to seal the opening closed to retain the object in the interior inter-wall cavities for shipping.

11. The packaging material web stock of claim 10, further comprising a first sealing material, disposed at the transverse seals, configured to form a seal at the transverse seals upon application of first conditions to the first sealing material, wherein the sealing material at the openings:

is a different material than the first sealing material; and is configured to form a seal at the openings upon application of second conditions to the sealing material at the openings.

12. The packaging material web stock of claim 1, wherein the overlaid plies include a hinge area disposed for folding the overlaid plies over each other at a hinge line that extends through the hinge area to divide the overlaid plies into first and second wall portions on opposite sides of the hinge line, such that the wall portions are folded about the hinge line to a folded configuration, defining the inter-wall cavities therebetween.

13. The packaging material web stock of claim 12, wherein the expansion material includes an expandable material configured, when in the expanded configuration, to cushion the object, the expandable material being disposed between the first and second plies in a main padding area, wherein the hinge area between the plies has less of the expandable material than in the main padding area such that, in the folded configuration, the hinge area is thinner than the main padding area.

14. The packaging material web stock of claim 1, wherein the expanding conditions include an expansion temperature sufficient to cause the expansion material to decrease in density and expand to the expanded configuration.

15. The packaging material web stock of claim 1, wherein the expansion material includes a plurality of materials separated by a barrier, wherein contact between the plurality of materials causes the expansion material to expand.

16. The packaging material web stock of claim 15, wherein the expanding conditions include a minimum force to be applied to the expansion material, wherein the minimum force is sufficient to cause the plurality of materials to make contact with each other.

17. The packaging material web stock of claim 16, wherein the minimum force is sufficient to cause the plurality of materials to mix.

18. The packaging material of claim 1, further comprising a region of weakness positioned between adjacent packaging units in the series of packaging units, wherein the region of weakness is configured to facilitate separation of the adjacent packaging units.

19. A system, comprising:

the packaging material web stock of claim 2; and an expansion device configured to apply the expanding conditions to the expansion material when unconsolidated from the high-density configuration.

* * * * *